United States Patent [19]

Larguia

[11] 4,370,837

[45] Feb. 1, 1983

[54] ARRANGEMENT FOR SELECTIVELY CHANGING THE RADIATION AND VIBRATION TRANSMISSION PROPERTIES OF PANELS

[76] Inventor: Constancio Larguia, 1175 Talcahuano, Buenos Aires, Argentina

[21] Appl. No.: 217,097

[22] Filed: Dec. 16, 1980

Related U.S. Application Data

[63] Continuation of Ser. No. 961,852, Nov. 17, 1978, abandoned.

[30] Foreign Application Priority Data

Nov. 22, 1977 [AR] Argentina ..... 270073

[51] Int. Cl.[3] ..... E04C 1/42

[52] U.S. Cl. ..... 52/1; 52/171; 52/306; 350/267

[58] Field of Search ..... 52/171, 173, 1, 743; 126/419; 350/267

[56] References Cited

U.S. PATENT DOCUMENTS

| | | | |
|---|---|---|---|
| 2,439,553 | 4/1948 | Winn . | |
| 3,091,006 | 5/1963 | Sahlertz | 52/171 |
| 3,903,665 | 4/1975 | Harrison . | |
| 4,147,002 | 4/1979 | Kautz | 52/171 |

FOREIGN PATENT DOCUMENTS

| | | |
|---|---|---|
| 158662 | 2/1968 | Argentina . |
| 191975 | 12/1972 | Argentina . |
| 1272614 | 8/1961 | France . |
| 1296922 | 5/1962 | France . |
| 494337 | 7/1968 | Switzerland . |

*Primary Examiner*—John E. Murtagh

*Attorney, Agent, or Firm*—Fleit & Jacobson

[57] ABSTRACT

An arrangement is disclosed, which allows the control of the radiation and vibration (light, heat, sound) transmission properties of one or more panels each comprising at least two spaced apart glass sheets mounted in a supporting frame. The arrangement allows the control of the flow of solid particles to and from the inner space comprised between both glass sheets. There are also disclosed practical structural means for connecting the several conduits of the control equipment and of one or more corresponding particle reservoirs to said inner space of the panels. Moreover, there are disclosed such connection means for any particularly known types of fixed or movable panels of this kind and, in the case of movable panels, for panels capable of rotating about a horizontal axis or a vertical axis and for panels capable of sliding in their frames in a horizontal or a vertical direction.

29 Claims, 29 Drawing Figures

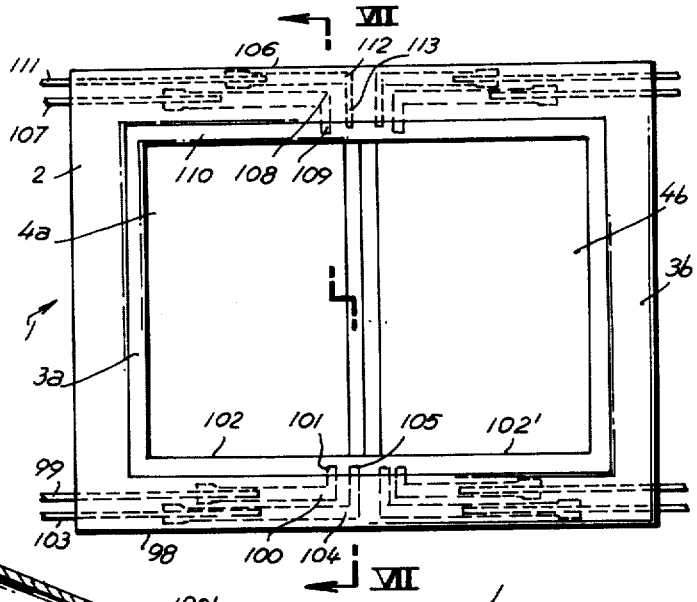
Fig. 5
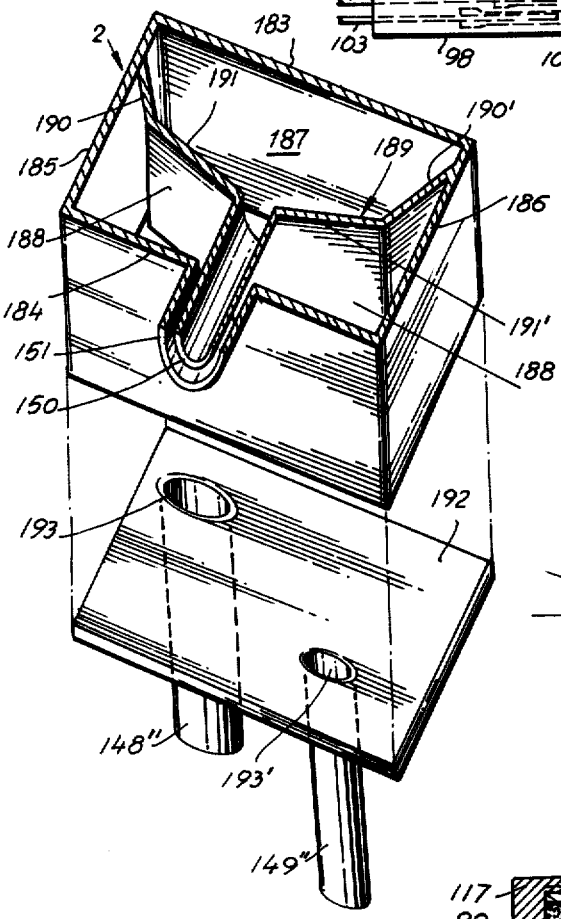
Fig. 10
Fig. 6
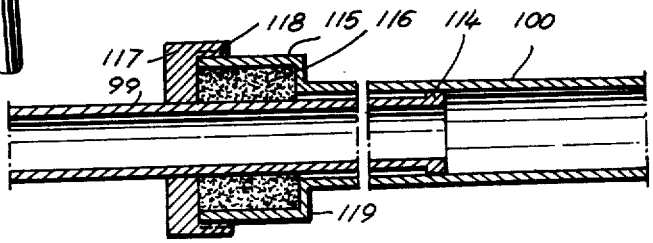

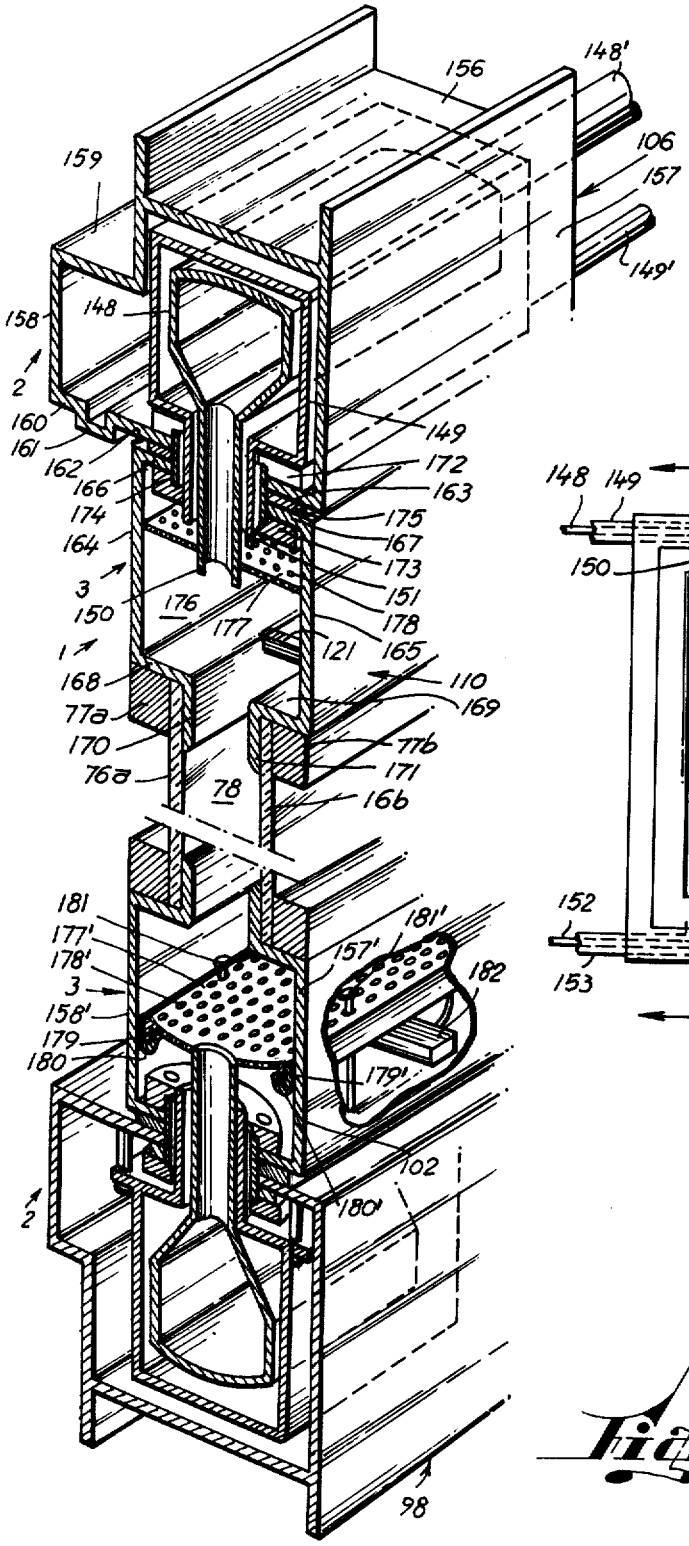
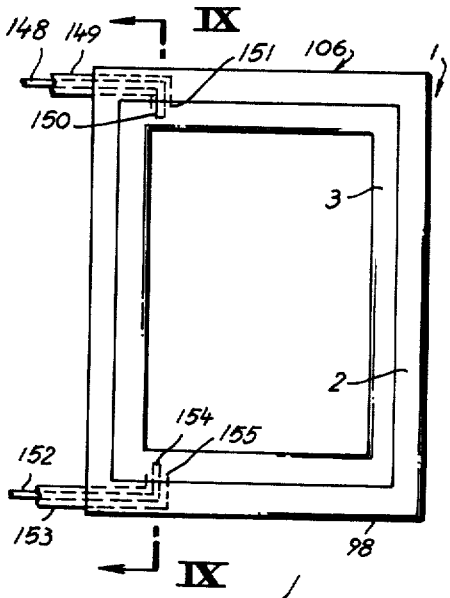
Fig. 8
Fig. 9

ARRANGEMENT FOR SELECTIVELY CHANGING THE RADIATION AND VIBRATION TRANSMISSION PROPERTIES OF PANELS

This is a continuation of application Ser. No. 961,852 filed Nov. 17, 1978, now abandoned.

BACKGROUND OF THE INVENTION

1. Field of the Invention

The present invention relates to an arrangement for selectively changing the radiation and vibration transmission properties of panels used in buildings and other structures. More particularly, it relates to an arrangement of the above indicated kind, specially designed to control the transmission of heat and sound of a panel formed of two parallel spaced glass sheets or the like of a composite window (stationary or movable), door, transom, skylight, space divider and the like.

2. Description of the Prior Art

There are known arrangements which may be used to the above effect. Such arrangements make use of a carrier consisting of little spheres of a low density material such as expanded polyestyrene. Although what has been proposed in the art gives some solutions about the manner in which the conduits may be embodied for conducting the solid carrier used from auxiliary means (such as storing vessels, pumps, valves and the like) to and from the space comprised between both glass sheets or like surfaces, and about the specific circuits, and the auxiliary equipments used, such solutions have by no means been satisfactory. Available art has not taught the way in which arrangements for changing the radiation and vibration transmission properties may be applied to moving panels of the kind mentioned, such as doors and sliding windows, transoms and the like. If in spite of the fact that the use of these systems with moving surfaces is vitally important.

Argentine Patent No. 158,662, teaches a frame structure provided with two spaced apart glass sheets, the edges of which are introduced in suitable slots provided in the frame, said frame having an internal channel (for conduction of a coloured liquid) which is communicated with the exterior of the frame and closable by means of a plug, the interior end of the channel being communicated with the space between the glass sheets. Frame structures provided with double glass sheets were already well known before the application for said patent was filed. A common example are the windows of aircrafts having pressurized cockpits. The system of that patent uses a liquid and is not suitable for use with solid particles. Moreover, that patent does not suggest solutions for the control of the material used and no means are described for the use of the system with moving structures.

In Argentine Patent No. 191,975 a structure is described which, in principle, is similar to that above mentioned, also using a liquid and providing conducting channels in the frame. Rather rudimentary control means are suggested, but such a structure offers many problems for the use of solid particles in place of a liquid and no means are suggested for using it with moving structures.

In U.S. Pat. No. 2,439,553 there is described a structure of this type using a coloured liquid and provided with conduits arranged within the frame. This structure has the same disadvantages above mentioned when the use of solid particles is attempted and is not apt for use with moving structures.

In U.S. Pat. No. 3,903,665, a structure for the use of solid particles is described, employing air currents of pressurized air for carrying the particles to and from the space comprised between the glass sheets. From the specification, it seems that the inventor conceived the structure only for thermal isolation and not for protection against light or sound. It does not give any solution for the case of moving surfaces and the conduits for carrying the material are schematic. In general, the structure described is of primitive construction when it is compared with the structures which are conceivable in present days, since many important problems appear, specially in the case of moving structures. No means are suggested for internally defrosting the glass sheets nor for cleaning the internal surfaces thereof.

In Swiss patent No. 494,337, there is described a simple and elemental structure for use with a liquid or with solid particles. The drawings are purely schematic and do not suggest solutions for moving structures nor for practical problems which may arise during the use thereof.

In French patent No. 1,272,614, a structure of this kind is described in a very crude form. No practical embodiments are shown (the patent has no drawings); only ideas and desires are mentioned, but no practical solutions are given. However, the use of light particles of expanded plastic material or a liquid is suggested. In either case, the means used may be coloured or not. Only as a simple idea, the "possibility" of using a window rotatable about a horizontal axis is mentioned, but filling and emptying is by simple gravity, rotating the window through 180° about its axis of rotation. This last possibility is shown and described in detail in another French patent which is mentioned below.

French patent No. 1,296,922 gives the practical details to put into practice the idea mentioned in the French patent of the above paragraph. According to this French patent, the frame which is rotatable about a horizontal axis, contains a hollow space capable of storing the solid particles, but which reduce the overall available transparent surface of the window which otherwise would be available. In a first closed position, the space between the glass sheets fills simply by gravity from the storage space. Rotating the window through 180°, this space is emptied, also by gravity,into said storage space. While the description and the drawings apparently provide much detail, there still remain problems which must be resolved; while the closing of the window in a first of said positions is easy to understand, it is not clear how the window can also offer a good sealing with its frame when it has rotated 180° from said first position.

In other words, the general idea of using a structure of this kind in which, between the two glass sheets, there is introduced a liquid or a granulated material, coloured or not, allowing thermal and/or light, and/or sound isolation, is certainly not new. However, none of the prior art known to the applicant gives practical solutions for the following problems in the case of structures using solid particles:

(a) The means, channels, and controls for the gaseous fluid used to carry the solid particles from a storing space to the space comprised between the glass sheets and viceversa in the case of a movable panel;

(b) A panel structure capable of allowing the cleaning of the internal surfaces of the glass sheets;

(c) Practical means to avoid the defrosting of the glass sheets;

(d) A complete circuit, not only of the structure of the frame and the panel glass sheets, but also of the channels and of the auxiliary means which are necessary for the operation of a single panel or, simultaneously, of a plurality of panels;

(e) Practical means for straightening the upper level of the solid particles within the panel when it is only filled up to a level which is below the maximum possible level; and (f) Other various practical features.

Moving panels may be classified within the following basic types.

(1) Glass carrying frames which are mounted in a main frame within which they are rotatable about a vertical axis;

(2) Glass carrying frames which are horizontally slidable in a fixed main frame;

(3) Glass carrying frames which are rotatable about a horizontal axis; this type may comprise the following sub-types;

(3*a*) The axis of rotation coincides with the horizontal axis of symmetry of the main frame;

(3*b*) The axis of rotation is parallel and adjacent to the upper edge of the main frame;

(3*c*) The axis of rotation is parallel and adjacent to the lower edge of the main frame;

(3*d*) The axis of rotation is in a position intermediate between 3*a* and 3*b* or between 3*a* and 3*c*; and (4) Glass carrying frames which are vertically slidable within a fixed main frame (guillotine type windows).

The present invention offers practical solutions for any of the four main types of panels mentioned above.

However, it is important to note that the present invention is not limited to any particular type of moving panel, since many solutions are offered here which are new and useful for its application to fixed panels.

Thus, one object of the present invention is to provide an arrangement for selectively changing the properties of transmission of radiations and vibrations of panels useful in openings in buildings and other structures.

More particularly, an object of this invention is to provide an arrangement of this kind which has conduits and controls which are essential for the efficient operation and use of a panel or group of panels.

Another object of the present invention is to provide an arrangement of this type which includes the equipments and auxiliary means which are necessary for an efficient operation of the panel or group of panels.

Another object of this invention is to provide an arrangement of this kind, including the coupling means necessary for the conduits when moving panels are used.

A more particular object of this invention is to provide an arrangement of this kind in which said coupling means are apt for movable panels capable of rotating about a vertical axis or about a horizontal axis, and coupling means apt for the use with movable panels of the sliding type, either in a horizontal or in a vertical direction.

A more specific object of this invention is to provide an arrangement of the kind mentioned in which the panels incorporate means allowing the cleaning of the surface of the glass sheets corresponding to the interior of the space comprised between the same.

Another specific object of this invention is to provide an arrangement of this type having auxiliary means which allow avoiding the frosting of the glass sheets, and defrosting them in case this would be necessary.

An object that is subsidiary to the one exposed in the immediately precedent paragraph is to provide an arrangement of this kind in which the equipment supplying the pressurized air, which constitutes the gas for carrying the solid particles, includes a device capable of drying the air supplied to the circuit.

Another subsidiary object is to provide an arrangement of this kind in which said auxiliary equipment incorporates a device capable of heating the air supplied to the circuit.

Another object of this invention is to provide means associated with the panel, which allow the use of a pressurized air supplying equipment capable of feeding a group comprising a plurality of panels and which eventually may be provided with means capable of reducing the electrical energy consumption proportionately to the number of panels in the group which are put into operation at the same moment, the equipment stopping automatically (does not consume energy) during the entire period of time in which no panel of the group is operated.

Another object of this invention is to provide an arrangement of the above mentioned type having panels comprising more than two glass sheets (or sheets of another suitable transparent material) which define more than one space between them, each space being fillable with a different material to obtain different effects in each case. For example:

(i) Isolation of light radiation;

(ii) Isolation of infrared radiation (thermal isolation);

(iii) Different degrees of translucency;

(iv) Different colours;

(v) Acoustic isolation; and (vi) Control of other properties.

Another object is to provide an arrangement of the kind mentioned which has pressurized air supplying means including a device capable of separating the dust and solid particles carried by the air.

SUMMARY OF THE INVENTION

These and other objects are attained by providing an arrangement for selectively changing the radiation and vibration transmission properties of panels for use in buildings and other structures, of the type comprising at least one panel having at least two parallel adjacent sheets of substantially transparent material mounted in a carrying frame, each two adjacent sheets being spaced apart by a substantially sealed intermediate space capable of receiving solid particles which are between translucent and opaque, the improvement residing in the fact that said intermediate space has at its upper portion at least one input for air and particles, and, below said at least one input for air and particles, an input for air only and at least an output for air and particles, the arrangement further comprising: at least one reservoir for containing a sufficient quantity of said solid particles and having at least one input for air and particles communicating with said output for air and particles of the panel, at least one output for air and particles communicating with said inputs for air and particles of the panel, one input for air only and an output for air only; a main conduit for conducting air only and communicating with said input for air only of the panel and with said inputs for air only of the reservoir, said main conduit for air only being communicated to the exhaust of a blower, the intake of which is communicated with the output of a dust filter, the input of said filter being connected to a second main conduit for sucking air only and which is connected to said reservoir output for air only, and respective gates arranged in conduits associated with each of said inputs and outputs of said panels and said reservoir, each gate being selectively adjustable to a first position closing the respective conduits and to a second position opening said conduits.

It must be noted that in this specification and in the claims, when reference is made to solid particles, this must be interpreted as not being limited to geometrically perfect spheres; in fact the particles may have considerable irregularities as long as they do not obstruct the free flow of the particles through the conduits and auxiliary devices.

In order to facilitate the comprehension of the present invention, various specific embodiments will now be described, by way of example, and with reference to the accompanying drawings, wherein:

FIG. 5 is a schematic representation of a panel comprising two movable frames which are horizontally slidable and which can be used in combination in the present invention;

FIG. 6 is a cross-section showing the telescopic elements of the embodiment of FIG. 5;

FIG. 8 is a schematic representation of a movable panel capable of rotating about a vertical axis;

FIG. 9 is a vertical section through an actual embodiment shown in perspective view of the arrangement schematically shown in FIG. 8;

FIG. 10 is a perspective exploded view of a detail showing an alternative embodiment of the rotative coupling for the stationary frame and which can be used in place of that shown in FIG. 9;

FIGS. 14 and 15 are perspective views, partially in section, of an actual embodiment of the idea shown in FIG. 11, and wherein FIG. 14 shows the conduit which leads to the upper portion of the movable frame while FIG. 15 shows the conduit which leads to the lower portion thereon;

Figures 24, 25A, 25B, 25C, 25D:
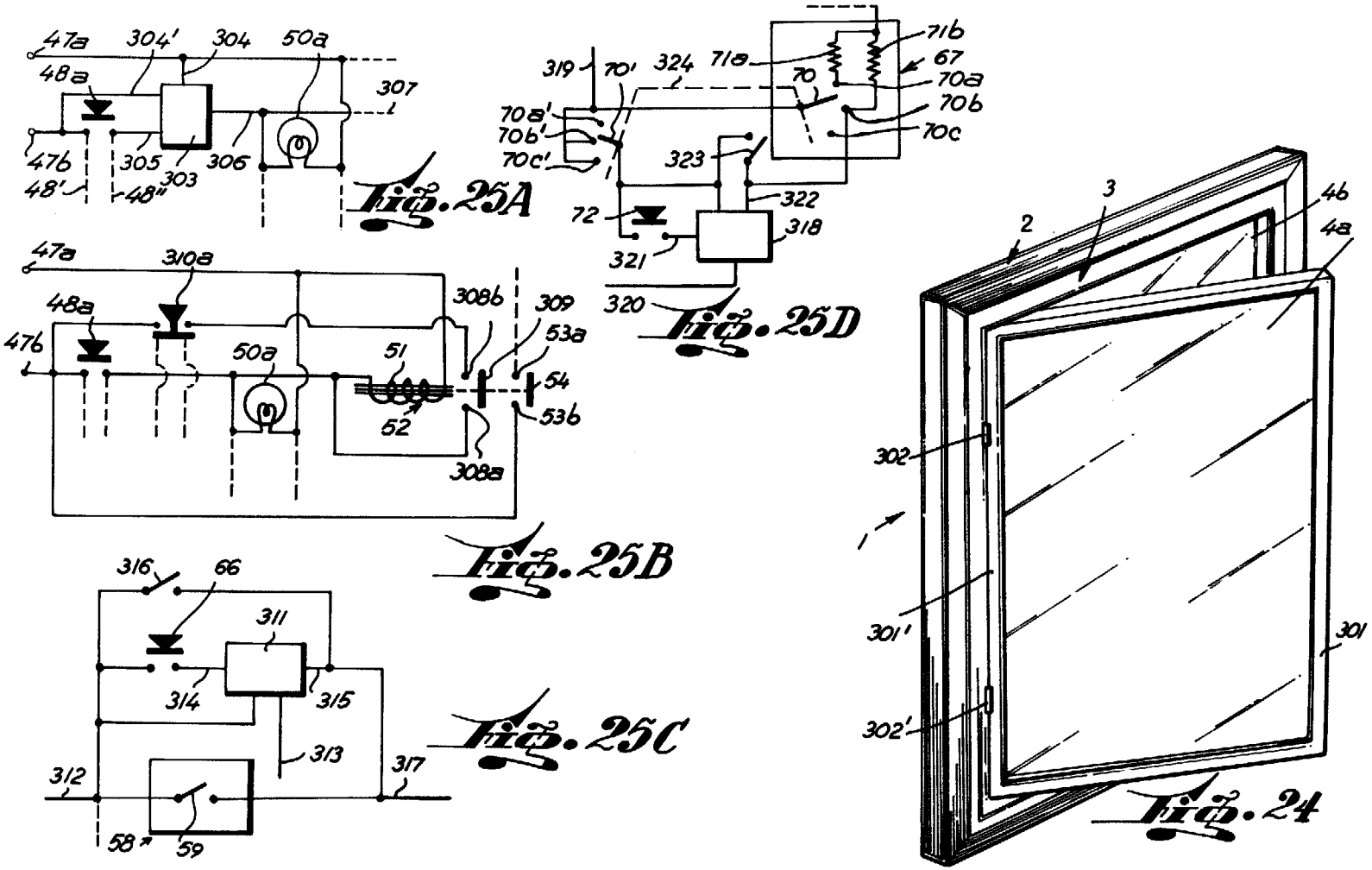

FIG. 24 is a schematic representation of a panel in accordance with the present invention and wherein one of the sheets of glass can be rotated outwardly whereby the space between both sheets of glass become accessible; and FIGS. 25-A, 25-B, 25-C and 25-D are diagrams showing details of the electric circuit which has been conceived to control the arrangement of the present invention. These figures show various alternatives.

In the drawings the same reference numbers indicate like or equivalent parts.

Figure 1:
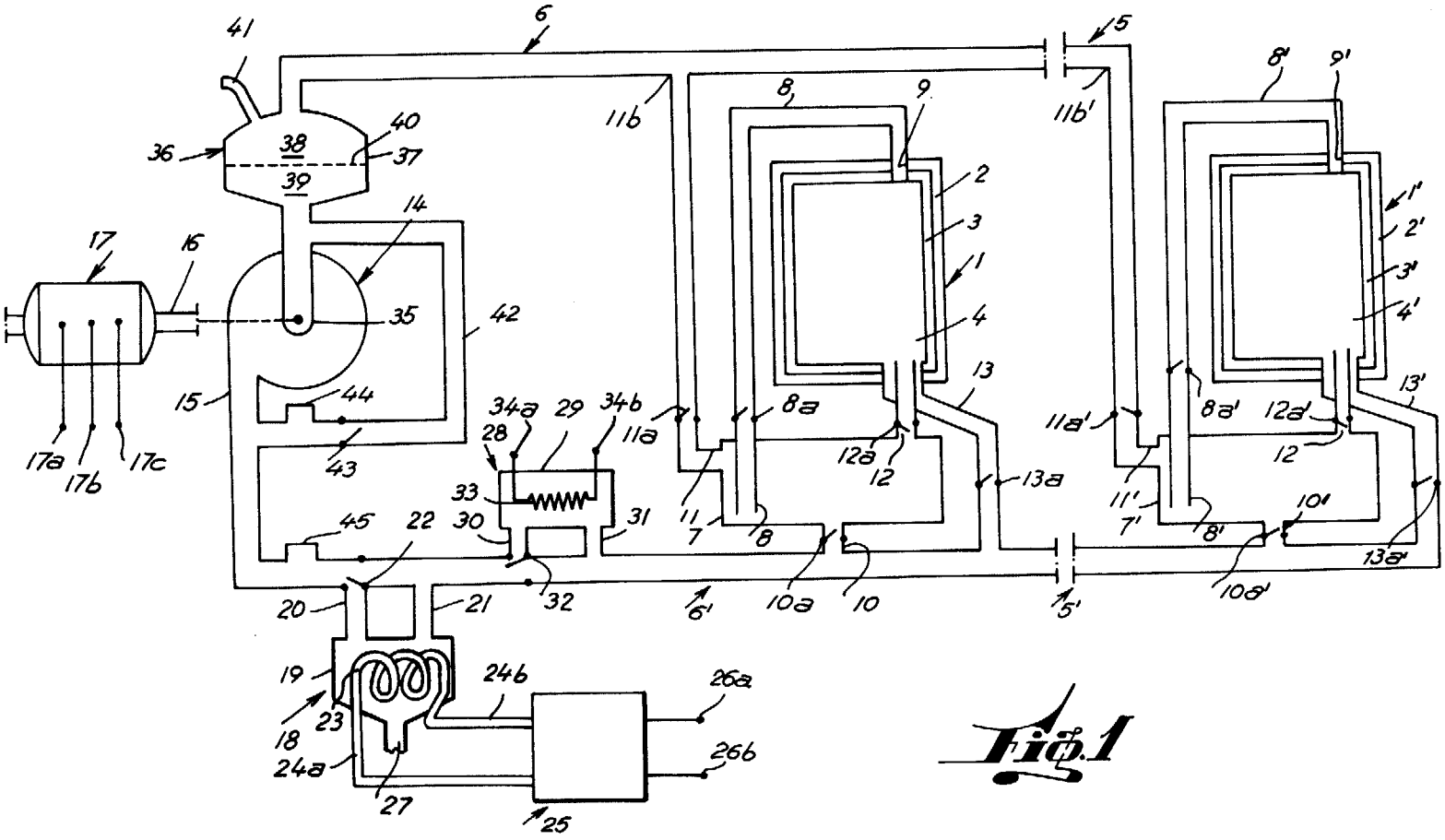
FIG. 1 is a schematic representation of an arrangement in accordance with the present invention and which comprises a plurality of panels and reservoir arrangements, together with corresponding circuits and control devices, but in which air cannot be extracted from the upper portion of the panel.

Reference will now be made to the drawings, and particularly to FIG. 1 wherein there is shown the arrangement according to the present invention, and which comprises the panels which are to be controlled with the aid of the conduits, reservoirs, air compressors, valves and filters, as well as with the other optional equipment such as a dehumidifier and a heater.

Reference numbers 1, 1' identify schematically represented panels whose radiation transmission properties are to be controlled by the present invention. These panels are in general of known type and comprise main frames 2, 2' and glass supporting frames 3, 3'. In the case of stationary structures (for example windows which cannot be opened), the glass supporting frames 3, 3' are not necessary, although they are obviously indispensable in the case of movable panels (windows which can be opened, doors and the like). Each panel comprises at least two sheets or panes of glass or other appropriate material) only one of which 4, 4' has been shown in FIG. 1. The sheets 4, 4' are spaced-apart thereby defining a substantially hermetic space therebetween (not shown) which is of sufficient size to receive therein particles of the material used to vary the radiation transmitting properties of the panel.

The overall arrangement may include a single panel with all its complementary control equipment or it may include a plurality of these panels controlled by a single control equipment, which will be common to all of them. In FIG. 1 an embodiment with two panels has been shown, although the interruptions indicated by references 5, 5', of the main conduits 6, 6' show that it is possible to include any amount of further panels, identical to panels 1, 1', between panels 1 and panel 1'.

The arrangement of the present invention comprises a panel 1 associated with a reservoir 7 for particulate material. An outlet conduit 8 for the particulate material, extends into reservoir 7 up to adjacent the bottom thereof. The opposite end 9 of conduit 8 opens into the upper portion of the space defined between sheets 4, 4' of each panel 1, 1'. The main conduit 6' for air under pressure communicates through 10 with the bottom of reservoir 7. An air suctioning conduit 11 is connected by one end to the upper portion of reservoir 7, and by its other end 11*b* with the main air suctioning conduit 6. In the lower portion of panel 1 there is provided a particle discharging conduit 12 leading into reservoir 7 and a conduit 13 for air under pressure and which is in communication with main conduit 6'.

In each one of conduits 8, 10, 11, 12 and 13 there is arranged, at an adequate location, a valve or gate 8*a*, 10*a*, 11*a*, 12*a* and 13*a*, respectively, which is manually controlable, capable of being taken into a closed position and into an open position. Operation of these valves may be either mechanic or electric (by means of relays) and according to what may be preferred.

The arrangement further comprises an air blower 14 which may be either centrifugal or of any other appropriate type. The outlet for air under pressure 15 is connected to the main conduit 6'. The rotor of blower 14 may be driven by any appropriate driving means such as the axle 16 of an electric motor 17. Three input conductors 17*a*, 17*b*, 17*c* have been shown connected with motor 17 so as to indicate that motor 17 is a two speed motor to which reference will again be made when the electric control circuit of the invention is described.

Along the portion of main conduit 6' comprised between outlet 15 of blower 14 and panel 1, an optional dehumidifying equipment 18 can be inserted. This equipment 18 comprises a chamber 19 having an input 20 communicated with main conduit 6' and an output 21 upstream with regard to input 20. Output 21 leads into main conduit 6'. A valve or gate 22 is mounted at the mouth of input 20; in a first position valve 22 closes input 20 whereby air flows directly along conduit 6' without entering chamber 19 and a second position in which input 20 is opened and conduit 6' is closed off whereby air is caused to flow through chamber 19. Chamber 19 houses a cooling arrangement 23 which is connected to a conventional cooling unit 25 by means of conduits 24*a*, 24*b*. Cooling unit 25 comprises an electric compressor (not shown) connectable with the power line 26*a*, 26*b* and a radiator. Cooling arrangement 23 causes the humidity in the air flowing thereover to become condensed thereon; the water falling from the outside surface of cooling arrangement 23 falls into the lower part of chamber 19 through conduit 27 into any adequate drain means. Under certain circumstances, ice can become formed on cooling arrangement 23 but this ice will melt when the arrangement is not active.

To avoid steaming of glass 4, which can occur under certain atmospheric conditions, an optional air heater 28 can be included. For simplicity reasons heater 28 can be electrically energized although any othe type of conventional heater will also be adequate. Consequently in FIG. 1 a heater 28 has been shown which comprises a chamber 29 having an inlet 30 in communication with main conduit 6', and an outlet 31 upstream with regard to the former, leading also into main conduit 6'. A valve or gate 32 is arranged at the mouth of inlet 30 and which in a first position closes the mouth of inlet 30 whereby the air flows along conduit 6' without entering chamber 29, and in a second position opens the mouth of conduit 30 and closes off conduit 6' whereby the air is caused to flow into chamber 29. Within chamber 29 there is a heating element consisting of an electrical resistor identified by reference number 33 and which has external terminals 34*a*, 34*b* which permits resistor 33 to be connected to the power source. Resistor 33 could also be positioned about the outside face of chamber 29.

Input end 35 of blower 14 is connected to the outlet of a dust filter identified in general by reference 36 and which comprises a container 37 having an input chamber 38 and an output chamber 39 separated by a filtering element 40. It will be understood that filter 36 has been only schematically shown inasmuch as that in actual fact it can adopt any configuration suitable for separating dust from air. For large installations in buildings having over 100 panels 1, filter 36 can be of the cyclone type or an electrostatic precipitator. Obviously according to circumstances various blowers 14 and air filters 36 can be grouped together.

Inasmuch as that the components of the air circuit, and particularly panels 1, 1' may not be absolutely hermetic, some means must be provided to inject air into the circuit to thus compensate losses. In FIG. 1 and by means of reference 41 there is identified an inlet for replenishing air and which leads into chamber 38 of filter 36 whereby the air which ingresses into the system is filtered. Air inlet 41 will have a cross-sectional area substantially smaller than main conduits 6, 6'.

In order to avoid the possibility that blower 14 will be in operation when no use is needed for air pressure in any of the panels 1, 1', it is advisable to provide a bypass 42 connected between input end 35 and the outlet 15 of blower 14 thereby avoiding over-pressures in the system. A relief valve 43 is inserted by bypass 42 and is adapted to open only (and while) the pressure in the system is above a certain value whereafter blower 14 will cause the air to flow along bypass 42.

At the inlet end of bypass 42, downstream with regard to valve 43, there is a pressurestat for switching motor 17 to one of two different speeds. When under certain circumstances the arrangement of the present invention is only used in connection with one panel of an installation comprising a plurality of panels, or no panel is being used, the pneumatic pressure in the circuit will increase substantially thereby activating valve 43 which will cause blower 14 to remain unnecessarily in operation. To avoid this, pressurestat 44 switches motor 17 to its low speed when the pressure in the circuit increases and thereafter only if the pressure in the circuit increases further will valve 43 become opened. Pressurestat 44 instead of being in the position shown in FIG. 1, in bypass 42, can be connected into main conduit 6' anywhere between outlet 15 of blower 14 and dehumidifier 18 and/or heater 28, when these last two are present, or if not between outlet 15 and the input to the panel and to the reservoir of the first panel 1 connected into the circuit.

A humidistat 45 can also be provided at any adequate location between the outlet 15 of blower 14 and the input 20 of dehumidifier 18. Humidistat 45 will automatically energize dehumidifier 18 when the dampness in the air flowing in the circuit reaches a predetermined value. Likewise, it will deenergize dehumidifier 18 when the dampness is below this predetermined value.

Figure 1A:
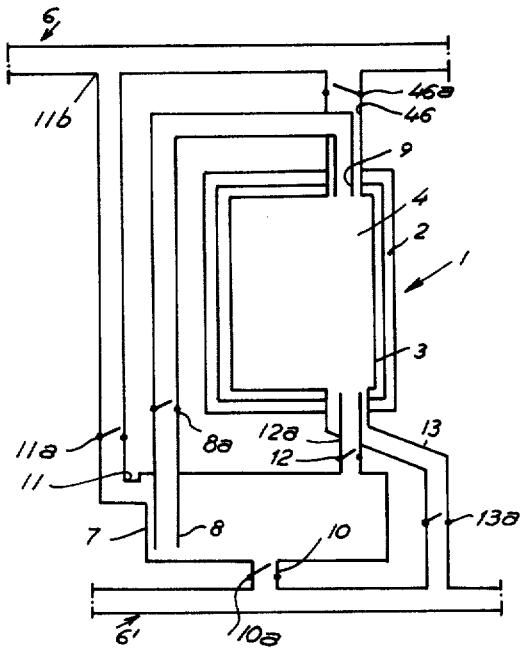
FIG. 1A is a schematic representation of a portion of FIG. 1 showing an alternative embodiment wherein it is possible to extract air from the upper portion of the panel.

In FIG. 1A there is shown an alternative embodiment which is adequate for certain specific panels to be described later on. This embodiment is identical to the previous one except that at the upper portion of panel 1 there is provided an additional communication consisting of a conduit 46 having a gate 46a. Conduit 46 is in communication on one hand with the space defined between glass sheets 4, and on the other hand with the main air suction conduit 6. Obviously although only panel 1 has been shown to comprise this additional communication, each and all the panels of the arrangement can be provided with this modification. This additional conduit 46 is particularly useful in the case of hermetic panels inasmuch as that it permits the egress of air from between glass sheets 4 while this space is being filled with particles. Additionally when the arrangement is operating in the closed circuit mode, filter 36 will be less subject to becoming dirty thus reducing the frequency of its change.

Figure 2:
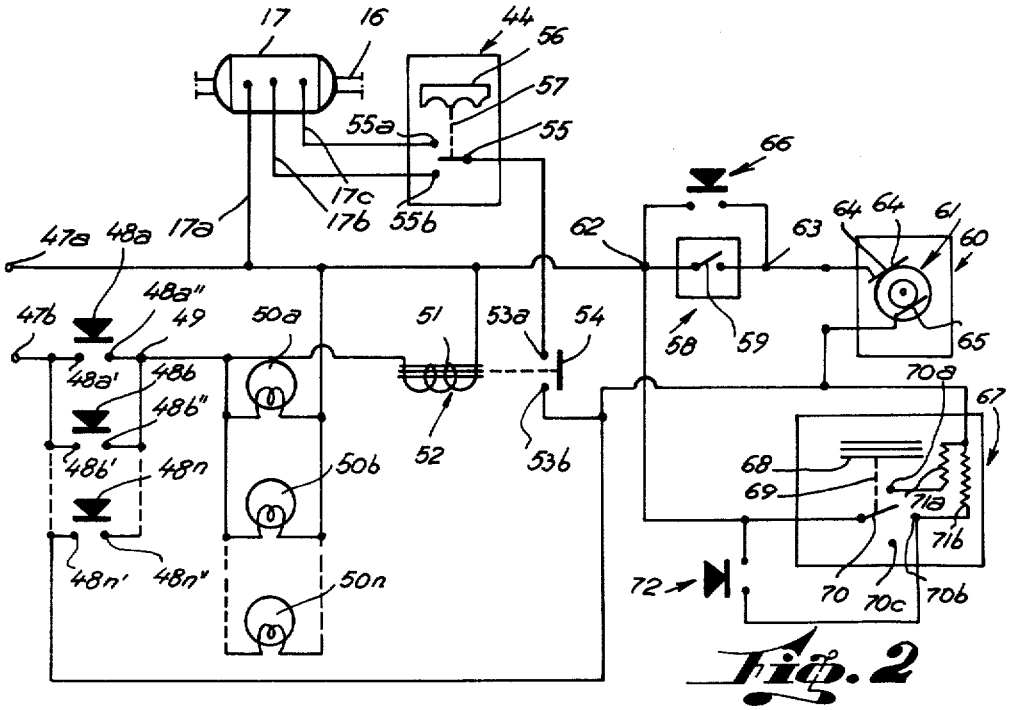
FIG. 2 is an electric diagram of a circuit for controlling the arrangement of FIG. 1.

In FIG. 2 there has been shown a diagram of an electric circuit for the control arrangements for the embodiments of FIGS. 1 and 1A.

In first place it is to be noted that a full arrangement has been shown and it includes various optional automatic control devices. The only component shown in FIG. 2 which is truly indispensable is motor 17 which has an axle 16 which drives blower 14. An expert in the art can modify this circuit in order to adapt it to leave out one or more of the optional components.

The circuit comprises terminals 47a and 47b connectable to an AC power source such as a conventional power supply grid. In the illustrated embodiment there is provided adjacent each panel 1, 1' a pushbutton for initiating operation of the arrangement and a light which during operation is energized thereby indicating that the arrangement is in use.

Pushbuttons or switches 48a, 48b . . . 48n, for initiating operation of the arrangement, are connected in parallel. Each switch has stationary contacts 48a' and 48a'', 48b' and 48b''. . . 48n' and 48n'' and a corresponding normally open movable contact mechanically connected to a pushbutton. Stationary contacts 48a', 48b' . . . 48n' are connected amongst themselves and to terminal 47b of the power source. Stationary contacts 48a'', 48b'' and 48n'' are connected amongst themselves and to junction 49.

Indicating lights 50a, 50b . . . 50n are also connected in parallel. One of the terminals of the group of lights is connected to junction 49 while the other terminal is connected to terminal 47a of the power source.

Output junction 49 of the set of pushbuttons is connected to one end of the winding 51 of a relay 52, the other end of which is connected to the terminal 47a of the power source. Relay 52 has a pair of stationary contacts 53a, 53b and a normally open movable contact 54. Stationary contact 53b is connected to terminal 47b of the power source while stationary contact 53a is connected to the movable contact 55 of pressurestat 44. Pressure sensitive member 56 (for example an aneroid capsule or the like) is in actuating relationship represented by dotted line 57, with movable contact 55. Pressurestat 44 has two stationary contacts 55a and 55b; contact 55a is connected to conductor 17c of motor 17 and corresponds to its high speed input; stationary contact 55b is connected to input conductor 17b which constitutes the low speed input for motor 17. Selector 55 of pressurestat 44 could have more than two positions if it is desired to include in the arrangement a motor 17 having more than two speeds. Common input conductor 17a of motor 17 is connected to terminal 47a of the power source.

The control arrangement may incorporate a humidistat for automatically connecting a humidifier. The humidistat has been shown in FIG. 2 by a simple block 58 which includes a switch 59. The dehumidifier has also been shown simply by a block 60. This known device 60 comprises a motor compressor, a circuit for refrigerant and a radiator. Only the electric motor 61 of the motor compressor has been schematically shown. One of the terminals 62 of the humidistat 58 is connected to terminal 47a. The other terminal 63 is connected to one of the brushes 64 of motor 61 while the other brush 65 is connected to the other terminal 47b. In parallel with humidistat 58, across terminals 62 and 63, there is a normally open pushbutton switch 66.

The control arrangement may also include a thermostat indicated in FIG. 2 by block 67 and which includes a two metal thermostatic element 68 mechanically connected in actuating relationship (as represented by dotted line 69) with a movable contact 70 of a selector switch also having three stationary contacts 70a, 70b, 70c. Movable contact 70 is electrically connected to terminal 47a. Each one of stationary contacts 70a and 70b is electrically connected to terminal 47b through a heating resistor 71a and 71b while stationary contact 70a is open. A normally open pushbutton switch 72 is connected across movable contact 70 and stationary contact 70b.

Obviously the circuit in FIG. 2 can be modified according to specific circumstances and these modifications will become evident upon analyzing the rest of this description.

Various embodiments for panels 1, 1' for use in the arrangements of FIGS. 1, 1A and 2 will now be described.

Figure 3:
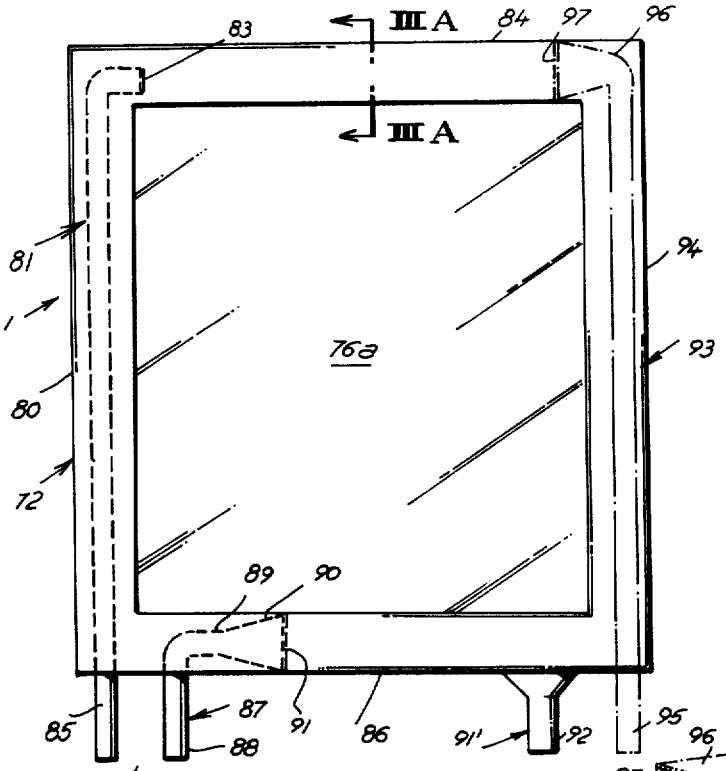
FIG. 3 is a schematic representation of a stationary panel adequate for use with the present invention.
Figure 3A:
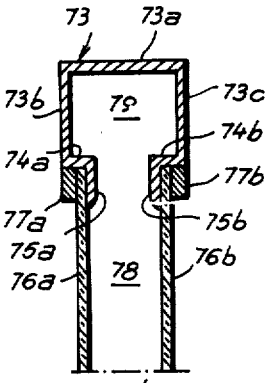
FIG. 3A is a vertical section along lines IIIA—IIIA in FIG. 3.

In first place a stationary panel 1 will be described with reference to FIGS. 3 and 4. FIG. 3 schematically shows a stationary panel and the conduits which extend in its frame. Panel 1 comprises a stationary frame which also acts as a glass supporting frame 72. In FIG. 3A there is shown a section of a portion of frame 72. This section is typical of the majority of the other embodiments described further on. The frame comprises a substantially tube shaped member of rectangular section 73 having walls 73a, 73b, 73c. Walls 73b and 73c extend into two inwardly folded flanges 74a and 74b which in turn extend into two perpendicular glass supporting ribs 75a and 75b. Against each outside face of ribs 75a and 75b, a pane of glass 76a and 76b is caused to rest and which is retained thereagainst by an auxiliary frame 77a, 77b. A space 78 for receiving particulate material such as spheres of expanded polyurethane is defined between glass panes 76a and 76b. Likewise a space or conduit 79 is formed within frame 73 and serves as a channel for air and particulate material.

It will be understood that when reference is made to glass panes, this is only by way of example inasmuch as sheets of any other optically appropriate material can be used. Obviously such material will preferably be transparent. Likewise the word pane or sheet is to be broadly interpreted to include curved, circular or spherical shapes.

Reference will again be made to FIG. 3 which shows a frame 72 which supports two panes of glass, only one of which, identified by reference number 76*a* is shown. A vertical conduit 81 extends within the left hand edge portion 80 of frame 72 and serves to conduct air carrying particles. Conduit 81 opens at 83 into the top edge portion 84 of the frame. The lower end 85 of conduit 81 is equivalent to conduit 8 of FIG. 1 which leads into reservoir 7. A conduit 87, for air only, opens into the bottom edge portion 86 of the frame. The end 88 thereof is equivalent to conduit 13 of FIG. 1 which after entering into the frame is bent 90° whereby it continues along a horizontal portion 89 opening into the space within bottom edge portion 86 through an outlet nozzle 90 having a filter 91 thereover capable of permitting air to egress therefrom but preventing the ingress of particulate material into conduit 87. Another conduit 91' enters the bottom edge portion 86 at another portion thereof spaced from conduits 85 and 87 whereby particulate material can be discharged from space 78 through conduit 92 which is equivalent to conduit 12 of FIG. 1, and which is in communication with reservoir 7. In the case of a panel in which air only is suctioned from its top portion, as in the arrangement of FIG. 1A, the frame can include an additional conduit 93 extending through the right hand edge portion 94 of the frame. The lower end 95 of conduit 93 is connected to conduit 46 shown in FIG. 1A. The upper end of conduit 93 extends at 96 at 90° with regard to the vertical portion thereof and its mouth 97 which is in communication with top edge portion 84, is protected by a dust filter.

Although it has been shown in FIGS. 1 and 1A that conduits 12, 13 and 9 and 46 are concentric when entering the frame, it will be obvious that this is only to simplify the drawings inasmuch as that each conduit can enter the frame at a different location. In the schematic drawings of FIGS. 1 and 1A no conduit has been shown as passing through the frame. However, in actual fact, at least part of the conduits may extend within or through the frame or even be formed totally or in part by the frame.

Figure 4:
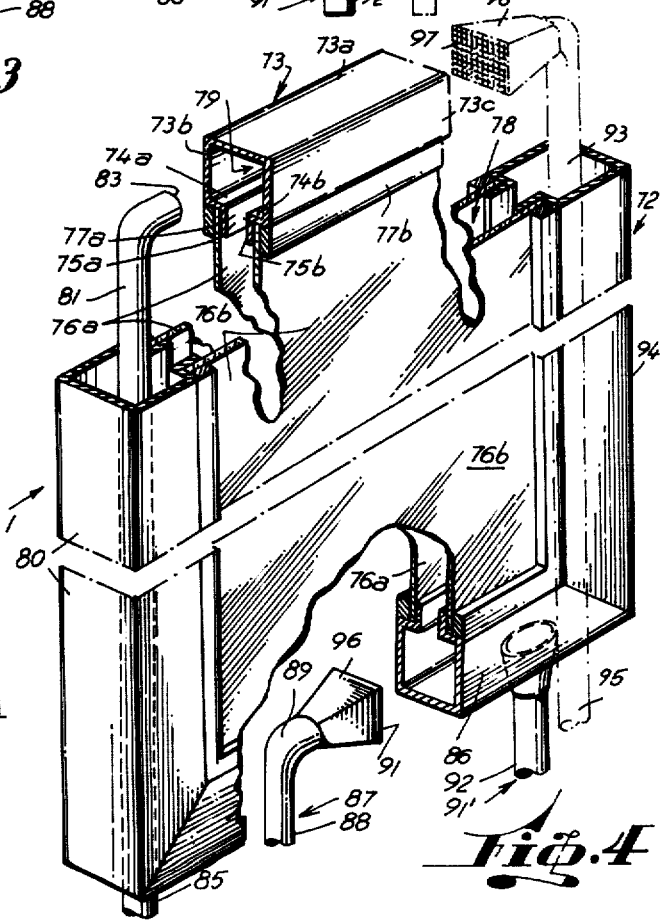
FIG. 4 is a perspective view, partially in section, showing an actual embodiment of the panel of FIG. 3.

In FIG. 4 an actual embodiment of the arrangement of FIG. 3, has been shown. As the same reference numbers are used, no further explanation appears to be necessary.

FIG. 5 is a schematic representation of a panel of the present invention which can be used in combination with the general arrangement shown in FIGS. 1 and 1A. According to this embodiment, panel 1 has a stationary frame 2 with two movable glass supporting frames 3*a*, 3*b* mounted therein. Frame 3*a* is provided with two panes (only the one identified with reference 4*a* is seen) spaced apart a certain distance so as to define therebetween a space adapted to receive particulate material. In the same way frame 3*b* is provided with two parallel spaced panes of glass (only the one identified with reference 4*b* is seen). Movable frames 3*a* and 3*b* are in non-coinciding parallel planes whereby each one can freely slide horizontally within frame 2. A conduit 99 connectable by one end to conduit 12 (FIGS. 1 and 1A) in communication with reservoir 7, is placed within the bottom edge portion 88 of stationary frame 2. The other end of conduit 99 is telescopically associated with a conduit 100 ending in a nozzle 101 oriented at 90° to conduit 100 and leading into the lower edge portion 102 of movable frame 3*a*. A second conduit 103 extends along the lower edge portion 98 of the stationary frame and is connectable, by one end, to conduit 73 (FIGS. 1 and 1A) which is in communication with the main conduit for air under pressure 6'. The other end of conduit 103 is telescopically associated with a conduit 104 ending in a nozzle 105 directed at 90° to conduit 104 and also opening into the interior of the lower edge portion 102 of movable frame 3*a*. Similarly a conduit 107 is placed within the upper edge portion 106 of stationary frame 2 and is connectable to conduit 89 (FIGS. 1 and 1A) which is in communication with reservoir 7. Conduit 107 is telescopically associated with a conduit 108 ending in a nozzle 109 directed at 90° to conduit 108 and opening into the interior of the top edge portion 110 of movable frame 3*a*. Optionally a second conduit 111 can be positioned within top edge portion 110 (to adapt this arrangement to the arrangement shown in FIG. 1A). Second conduit 111 is connectable to conduit 46 of FIG. 1A. The other end of conduit 111 is telescopically associated with a conduit 112 ending in a nozzle 113 directed at 90° to conduit 112 and also opening into the top edge portion 110 of movable frame 3*a*. As this last mentioned telescopic arrangement is optional it has been shown in dot and dash lines. The conduits corresponding to the other movable frame 3*b* are allochiral of those corresponding to movable frame 3*a* so it is unnecessary to repeat the above explanation.

FIG. 6 shows one of the possible embodiments for the telescopic coupling between conduits 99–100, 103–104, 107–108, (and eventually 111–112 if included) of FIG. 5. To further illustrate this matter the coupling between conduits 99 and 100 will be explained by way of example. Conduit 99 at its end which extends into stationary frame 2, has a rim 114 extending perpendicularly to the longitudinal axis of conduit 99. Conduit 100 is slidably mounted over conduit 99 whereby rim 114 is in contact with the internal surface of conduit 100. The end of conduit 100, opposite to that ending in nozzle 101, has a portion of enlarged diameter 115 defining a step 116. A cover 117 is secured (by welding or screw threaded) to diameter 115. Cover 117 has an edge 118 having an internal diameter substantially equal to external diameter of diameter 115. Consequently a space is defined within portion 115 which is filled with a bushing 119 of low friction material which also serves to seal conduit 99 to conduit 100. Bushing 119 can be made from felt, Teflon or other appropriate material. Bushing 119 acts as an abutment capable of resiliently interacting with rim 115 thus preventing conduit 99 from becoming withdrawn from inside conduit 100 when the telescopic arrangement is fully extended.

Supposing that glass supporting frame 3*a* is moved to the right, as seen in FIG. 5, nozzle 101 together with conduit 100 will also move to the right together with frame 3*a* whereby nozzle 101 will always remain in the same relative position with regard to the frame. On the other hand, conduit 100, which will also accompany the movement of the frame, will move to the right (as shown in FIG. 6) and portion 115 will approach rim 114 inasmuch as that the latter is integral with conduit 99 which is stationary together with stationary frame 2. In this way it is possible to move frame 3*a* from the utmost closed position to the utmost open position and vice-versa. The above explanation is applicable to any of the other three pairs of conduits and it is equally valid for the case in which the glass supporting frame 3*b* moves to the left, from its closed position towards its open position and viceversa.

Figure 7:
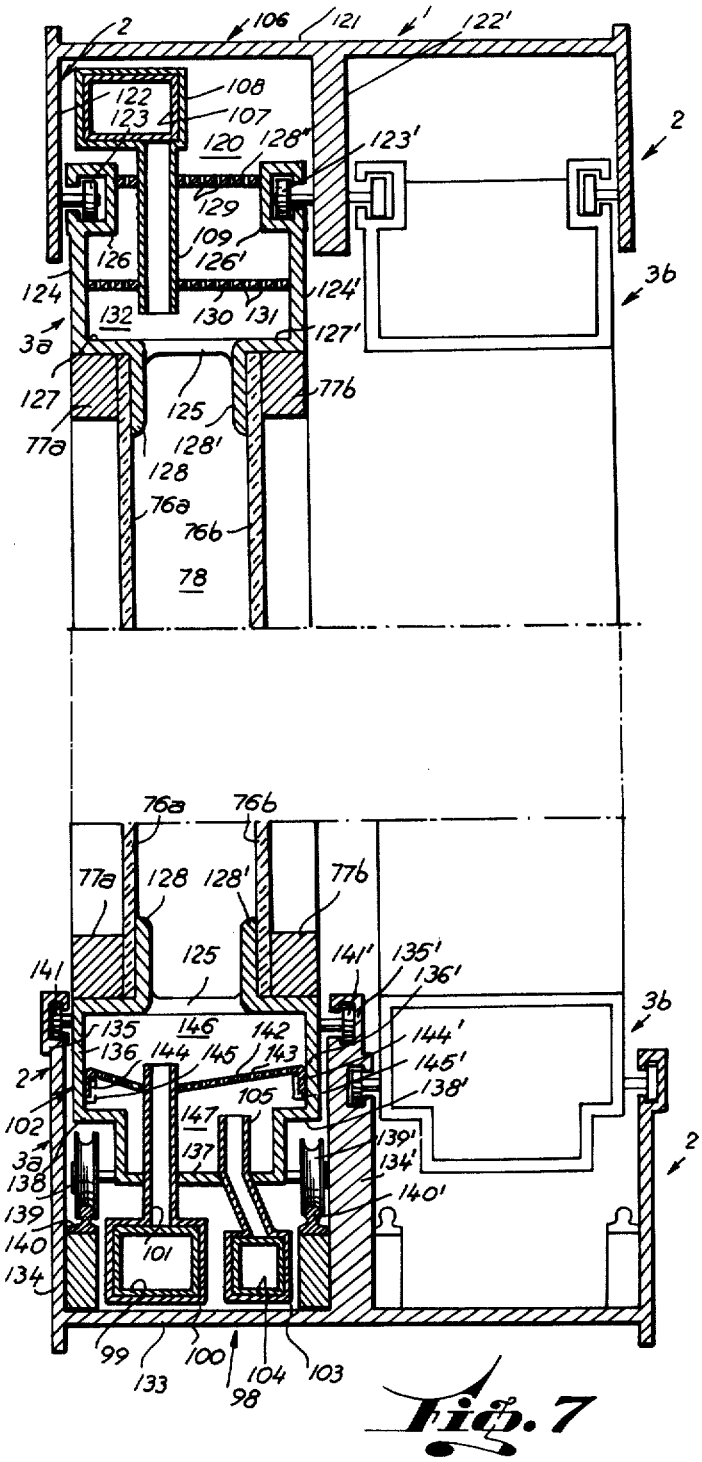
FIG. 7 is a vertical section through a panel arrangement according to the present invention and showing an actual embodiment of the arrangement of FIG. 5.

With reference now to FIG. 7, an actual embodiment of the panel schematically shown in FIGS. 5 and 6, will be described. FIG. 7 is a cross-section taken along lines VII—VII in FIG. 5. Panel 1 comprises a stationary frame 2 of inverted U-shaped cross section wherein a hollow space 120 is defined. The upper portion 106 of stationary frame 2 comprises a top wall 121 and lateral flanges 122, 122'. Guide wheels 123, 123' are mounted on the inner face of flanges 122, 122'. Glass supporting frame 3*a* comprises two lateral evenly spaced apart lateral flanges 124, 124' held in relative position by bridge 125. Lateral flanges 124, 124' define at their upper end guide channels 126, 126' within which guide wheels 123, 123' can freely wheel. At their lower end each lateral flange 124, 124' defines an inwardly directed shoulder 127, 127', respectively, provided with flanges 128, 128' directed towards the inside of the frame. Glass panes 76*a* and 76*b* rest against the external surfaces of flanges 128, 128' whereby they are spaced-apart, thereby defining inbetween an interior space 78 for receiving the particulate or spherical material. Guide channels 126, 126' are spaced apart by a foraminous plate 128 having a plurality of perforations extending therethrough and whose section is of little importance as long as air can move freely therethrough. Plate 128" serves as an upper strengthening member for frame 3*a*. Closer to shoulder 127, 127' a second foraminous plate 130 is also provided between lateral flanges 124, 124'. Second plate 130 is secured to lateral flanges 124, 124' and is also provided with a plurality of perforations 131, such perforations having a cross sectional area smaller than the diameter of the smallest particle of the particulate material used whereby such particulate material is prevented from passing through perforations 131 although air may move freely therethrough. Plate 130 may be replaced by a wiremesh or by some other material porous to air although the latter could cause a noticeable resistance to the flow of air. Additionally, such porous material could become obstructed in the course of time due to the presence of dust. Within space 120 of stationary frame 2 there are telescopic conduits 107 and 108 and nozzle 109. An expert in the art will understand that conduits 107 and 108 may be of any cross-sectional configuration without in any way affecting the basic concept of the present invention. Nozzle 109 extends through plates 128" and 130 and opens into space 132 defined in the lower portion of glass supporting frame 3*a*. When conduit 107 receives the particulate or spherical material drawn by a current of air under pressure, such particulate material will be fed into conduit 108 and thereafter into nozzle 109 whereby it will become discharged into space 132 wherefrom it will fall into space 78 defined between panes 76*a* and 76*b*. The air which has drawn the particulate material will escape through plates 130 and 128" towards space 120 wherefrom it will return to atmosphere through the imperfect joint between channel 126 of movable frame 3*a* and flange 122 of stationary frame 2.

Lower portion 98 of stationary frame 2 is slightly different. It comprises a lower wall 133 and two lateral flanges 134 and 134'. Lateral flanges 134 and 134' end in guide channels 135-135'. Movable glass supporting frame 3*a* comprises two lateral flanges 136, 136' connected one to the other at their lower ends by a structure comprising a transverse member 137 and shoulders 138, 138'. Small guide wheels 139, 139' are mounted, at appropriate intervals, on the outside of member 137; such guide wheels 139, 139' are adapted to run on support rails 140, 140'. Additional guide wheels 141, 141' are mounted, at regular intervals, on the lateral walls of movable frame 3*a* to run within guide channels 135, 135'. Within movable frame 3*a* there is provided a plate 142 having a plurality of perforations 143 extending therethrough. Plate 142 is similar to plate 130 but with the difference that its longitudinal edges are bent downwardly thereby forming flanges 144, 144' capable of fitting into channels 145, 145' for freely slidable movement therein. Channels 145, 145' are formed on the inner face of lateral flanges 136, 136'. In this way plate 142 can be submitted to a slight vibratory motion by means of a small vibrator so as to shake up the particulate material or spheres deposited on plate 142. To cooperate with this action, particularly to level the mass of spheres when space 78 is partially full of such spheres, an arrangement is provided in the lower portion of stationary frame 2, comprising an external telescopic conduit 103 and an internal telescopic conduit 104 (see also FIG. 5). Conduit 103 is provided with a nozzle 105 extending through transverse member 137 whereby it is integral and movable therewith. Conduit 104 is stationary within stationary frame 2. A second telescopic arrangement is positioned parallelly to telescopic arrangement 103, 104, also in the lower portion of stationary frame 2. This second telescopic arrangement comprises conduits 99 and 100 which includes a nozzle 101 which extends through transverse member 137 whereby it is movable therewith. Nozzle 101 extends through plate 142 so as to discharge the particulate material or spheres into space 146 wherefrom such spheres, into the space 78 defined between panes 76*a*, 76*b*, flow.

The structural differences between the upper part (upper half of FIG. 7) and the lower part (lower half of FIG. 7) of movable frame 3*a*, should be noted, particularly insofar as that in the upper part the space 132 within movable frame 3*a* is in communication with the space 120 within stationary frame 2 through plate 128" while in the lower part of the movable frame 3*a* there is no such communication inasmuch as that transverse member 137 is not provided with perforations and nozzles 101 and 105 extend hermetically therethrough. The air discharged by nozzle 105 first enters space 147 and then flows through plate 142 into space 146, thereafter into space or chamber 78 through the interstices existing between the particulate or spherical material accumulated therein. Thereafter, the air flows into space 132, through plates 130 and 128" into space 120 wherefrom it returns to atmosphere through the interstices existing between the stationary and movable frames.

FIG. 8 is a purely schematic representation of an alternative embodiment of the present invention in which the movable frame is rotatable about a vertical axis. Panel 1 comprises a stationary frame 2 and a movable glass supporting frame 3. Upper edge portion 106 houses two concentric conduits 148, 149 between which there is defined an annular space preferably arranged to conduct air only while conduit 148 is provided for conducting particles and air. Coinciding with the rotational axis of movable frame 3, the conduits are bent 90° so that their axes are aligned with the axis of rotation of the movable frame. The ends of conduits 148, 149 define a nozzle 150 and a mouth 151. Bottom edge portion 98 of stationary frame 2 houses two concentric conduits 152, 153 between which an annular space is defined perferably for conducting air alone while conduit 152 preferably conducts particles and air. Coinciding with the rotational axis of movable frame 3, the conduits are bent 90° so that their axes are aligned with the axis of rotation of the movable frame. The ends of conduits 152, 153 define nozzles 154, 155. It will be understood that it is also feasible to use conduits 148, 152 to conduct air only and to use conduits 149, 153 to conduct particles and air. The panel arrangement shown in FIG. 8 can be used in combination with the arrangement shown in FIG. 1A.

FIG. 9 shows the details of a possible actual embodiment of the panel arrangement shown in FIG. 8. The stationary frame is identified in general by reference number 2 while the rotatable glass supporting frame is identified by reference number 3. Stationary frame 2 comprises a top edge portion 106 and a bottom edge portion 98. Top edge portion 106 comprises a top wall 156 and two lateral flanges 157–158. Flange 158 has an outwardly extending portion comprising an upper wall 159 and a lower wall 160. The lower wall 160 has a downwardly extending rib 161. Flanges 157 and 158 comprise horizontal flanges 162, 163. Within top edge portion 106 inner and outer horizontal conduits 148 and 149 are housed. Conduits 148–149 end outside stationary frame 2 in conduits 148', 149'. Conduit 148' is to be connected to conduit 8, 9 shown in FIG. 1A while conduit 149' is to be connected to conduit 46 also shown in FIG. 1A. Conduit 148 at its end leading into stationary frame 2 is closed (this is not seen in FIG. 9) but therefrom a nozzle 150 extends downwardly. Conduit 149 is also closed and extends downwardly to form a mouth 151 which is concentric about nozzle 150. Frame 3 comprises two lateral walls 164–165 which have at their upper end inwardly bent flanges 166, 167 while at their lower end they have inwardly directed shoulders 168, 169 comprising downwardly extending flanges 170, 171. Glass panes *76a*, *76b* rest against the outer face of flanges 170, 171 and are retained in position by means of auxiliary frames *77a*, *77b* whereby space 78 is defined between the panes of glass, for receiving the particulate or spherical material. The lower portion of rotatable frame 3 is reinforced by bridges 125 arranged at regular intervals along the frame whereby large openings remain therebetween so as to permit the free flow of particulate material. The bearing assembly about which frame 3 can rotate comprises an upper bearing ring 172 and a lower bearing ring 173. Upper bearing ring 172 comprises on its external lower periphery, and lower bearing ring 173 comprises on its upper external periphery, respectively appropriate recesses for receiving the upper and lower edges respectively of a bushing 174. Upper bearing ring 172 is secured to horizontal flanges 162, 163 of stationary frame 2, while lower bearing ring 173 is secured to flanges 166, 167 of movable frame 3. A washer, preferably of low friction material 175, is positioned between flanges 162, 163 and 166, 167. Nozzles 150 and mouth 151 extend right through the structure formed by components 172, 162, 163, 174, 175, 167 and 173 thereby opening into the space 176 defined within movable frame 3. Consequently the particulate material can flow freely from nozzle 150 into space 176 and from here between bridges 125 into the space 78 defined between the panes of glass *76a*, *76b*. Space 176 is divided into two, that is to say, the part where mouth 151 opens thereinto and the part where nozzle 150 opens into this space, by means of a perforated wall 177 having a multiplicity of perforations 178 for permitting the flow of air but not the passage of particulate or spherical material. The lateral edges of perforated wall 177 are adequately secured to the internal surface of lateral walls 164 and 165 of movable frame 3.

Lower edge portions 98 and 102 of frames 2 and 3 comprise an arrangement similar to that described for upperedge portions 106 and 110 of said frames. One difference resides in the fact that wall 177' with its perforations 178' is not secured stationarily to the inner walls of the movable frame 3. The longitudinal edges of wall 177' have downwardly directed flanges 179, 179' capable of slidably fitting into channels 180, 180' respectively, which are secured to the inner faces of lateral flanges 157' and 158' of movable frame 3. Guide pins 181, 181' are provided and comprise an enlarged heat which acts as an abutment to restrict the vertical movement of wall 177' so as to prevent flanges 179 from coming out of channels 180 but permit a limited oscillatory vertical movement of wall 177'. Wall 177' has associated therewith a small vibrator, schematically shown and identified by reference 182, of any adequate type known in the art, which causes wall 177' to vibrate vertically.

FIG. 10 shows an alternative embodiment of the conduits within stationary frame 2. Only the upper portion of the frame has been shown, it being understood that the lower portion is similar. In this drawing supplementary features, as shown in FIG. 9, have been omitted although obviously they can also be incorporated into this embodiment.

The distinctive features of the embodiment of FIG. 10 are the corresponding positioning of the external outlets 148''–149''. In this embodiment stationary frame 2 has a truly rectangular cross-section and comprises a top wall 183, a bottom wall 184 and lateral walls 185 and 186. The inside of frame 2 is divided into two spaces 187 and 188 by a partition 189 having two portions of pronounced downwardly inclination 190, 190' which extend up to about the middle of the space within the frame and which then extend into a wall portion 191, 191' of less inclination which meet in the middle of the frame. A downward conduit defining a nozzle 150 is formed where inclination 190 and wall portions 191 meet. Towards the center of bottom wall 184 there is an opening extending downwardly and defining mouth 151. The internal cavity of frame 2 is closed a short distance from both ends; the first closure is not shown, although in FIG. 10 it is possible to see the back closure lid 192 from which external connection conduits 148'', 149'' extend. From FIG. 10 the position of the openings into conduit 148'', 149'' can be seen. Opening 193 permits conduit 148'' to be connected to space 187 and to nozzle 150 while opening 193' permits conduit 149'' to be communicated with space 188 and thereafter to mouth 151. The remainder of the arrangement, including the rotating connection means between stationary frame 2 and movable frame 3 can be identical to that shown in FIG. 9.

Figure 11:
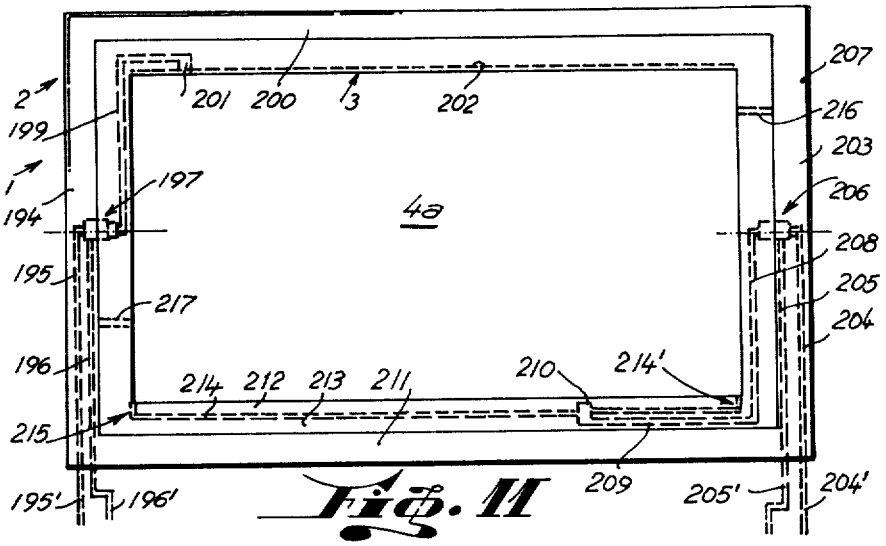
FIGS. 11, 12 and 13 are schematic representations showing the use of the present invention with panels having a movable frame rotatable about a horizontal axis positioned towards the center of the lateral edges of the movable frame, close to the upper edge of the movable frame and close to the bottom edge of the frame respectively.
Figure 12:
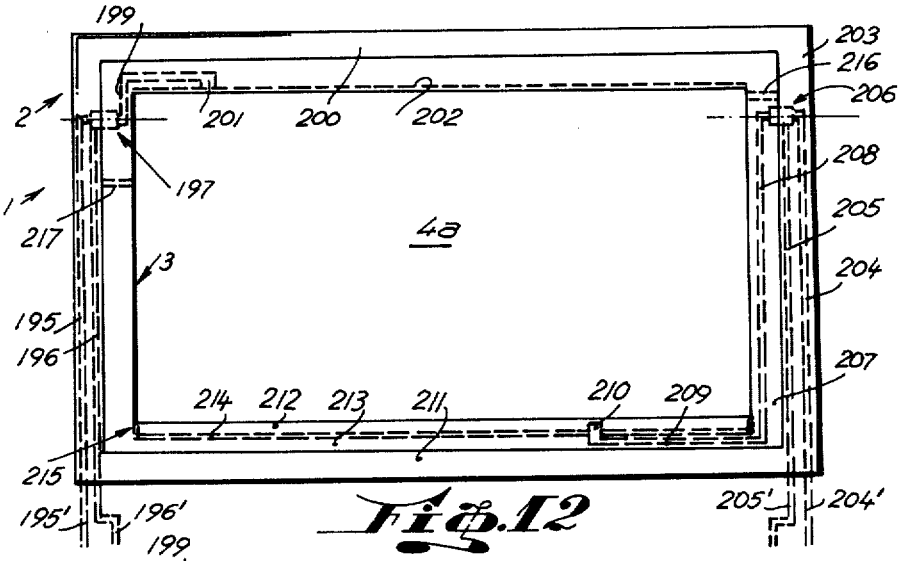
Figure 13:
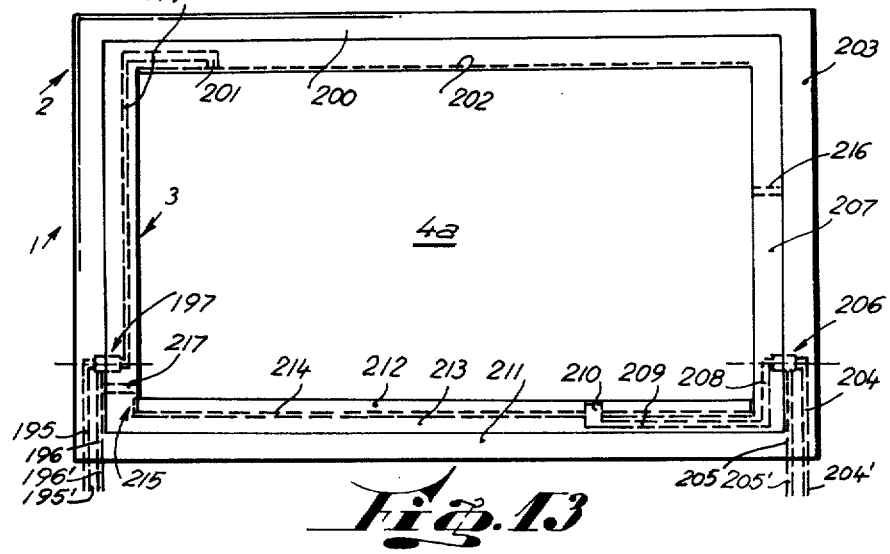

FIGS. 11, 12 and 13 schematically shown alternative embodiments for use with panels having a movable frame rotatable about a horizontal axis. FIG. 11 shows the case in which the axis of rotation of the movable frame coincides with the central geometrical axis of the panel; FIG. 12 shows an embodiment in which the axis of rotation is close to the upper edge of the movable frame while FIG. 13 shows a case in which the axis of rotation is close to the lower edge of the movable frame.

By referring to FIG. 11 it will be seen that panel 1 comprises a stationary frame 2 and a movable frame 3. Within lateral edge portion 194 of stationary frame 2 there extends a conduit 195 for particulate or spherical material and air (in which the material is entrained); conduit 195 continues outside of stationary frame 2 by way of external connector conduit 195'. Likewise conduit 196 for conducting air only continues outside of stationary frame 2 by way of connector conduit 196'. Movable frame 3 is rotatably mounted in stationary frame 2 by means of an axle arrangement identified in general by reference number 197 and which includes two concentric passages (not shown in FIG. 11) through which conduits 195 and 196 are in communication with the hollow inside of movable frame 3. The passage to which conduit 196 is connected leads directly into the hollow interior of lateral edge portion 194 of movable frame 3. On the other hand the passage within axle arrangement 197, to which conduit 195 is connected, is connected to a conduit 199 which extends a short distance within top edge portion 200 of movable frame 3 and ends in a nozzle 201 directed into the space comprised between the two panes of glass (of which only pane 4a is visible in FIG. 11). The lower part of top edge portion 200 of movable frame 3 (that is to say the part thereof which is directed towards the space comprised between both panes of glass) is covered with a perforated plate 202 (schematically shown) having perforations which are sufficiently small to permit the free flow of air therethrough but insufficiently large to permit the passage therethrough of the particulate or spherical material used to fill the inside of the panel. Nozzle 201 extends through plate 202 so as to end directly in said space.

Within lateral edge portion 203 of stationary frame 2 there is mounted a conduit 204 for conducting the particles together with the air in which they are entrained, for withdrawing such particles from within the panel. This conduit 204 is in communication with an external connecting conduit 204' which extends outside of stationary frame 2 while conduit 205, for conducting only blowing air, is in communication with connecting conduit 205' which extends outside of stationary frame 2. Movable frame 3 rotatably mounted in stationary frame 2 comprises a second axle arrangement identified in general by reference 206 and which includes two concentric passages (not shown in FIG. 11), through which conduits 204 and 205 are in communication with the inside of movable frame 3. The passage to which conduit 205 is connected leads directly into the hollow interior of lateral edge portion 207. On the other hand the passage to which conduit 204 is connected is in turn connected to a conduit 208 which extends a short distance along bottom edge portion 209 of movable frame 3 and ends in a nozzle 210 directed into the space comprised between the two panes of glass (of which only pane 4a is visible in FIG. 11). The inner space of lower edge portion 211 of movable frame 3 is divided into an upper part 212 and a lower part 213 by a longitudinal partition 214 extending across lower edge portion 211. Upper part 212 is closed at its end adjacent lateral edge portion 207 by an extension 214' of partition 214 while the opposite end of upper part 212 is partially closed by a perforated wall 215 which permits the free flow of air therethrough but restricts the passage of particulate material therethrough. Consequently, the air under pressure egressing through the passage within axle arrangement 206 which is associated with conduit 205 flows along lateral edge portion 207 of the movable frame 3 downwardly into lower part 213 and then through perforated wall 215 into upper part 212 and thereafter into the space defined between the glass panes 4a of the panel thereby agitating the particles in those zones where they can become stuck, thus facilitating levelling of the upper edge of the mass of spheres or particulate material accumulated in the space between the panes of glass. To prevent the air blown into the space 213 within movable frame 3 by conduit 205 from being directed along the inside of the frame 3 directly into air suctioning conduit 196, auxiliary blocking panels 216 and 217 are provided in the lateral edge portions 207 and 194.

FIG. 12 shows an alternative embodiment which is very similar to that of FIG. 11 but with the difference that it has been adapted to the fact that the axis of rotation of movable frame 3 is close to the upper edge thereof. In view of the similarity between the embodiments of FIGS. 11 and 12, in which the same reference numbers have been used to identify the same or similar parts, it will be sufficient to point out that the difference between one embodiment and the other reside in that conduits 195 and 196 as well as conduits 204 and 205 extend upwardly up to the axis of rotation of movable frame 3. Although conduit 199 is shorter in this embodiment, conduit 208 is longer.

The differences pointed out between the embodiments of FIGS. 11 and 12, will make it easier to understand the differences between the embodiments of FIGS. 11 and 13 which are also most similar except that the axis of rotation of movable frame 3 is close to the bottom edge of this frame. Consequently conduits 195 and 196 are considerably shorter while conduit 199 is longer. Additionally conduits 204, 205 and 208 are shorter.

Figure 14:
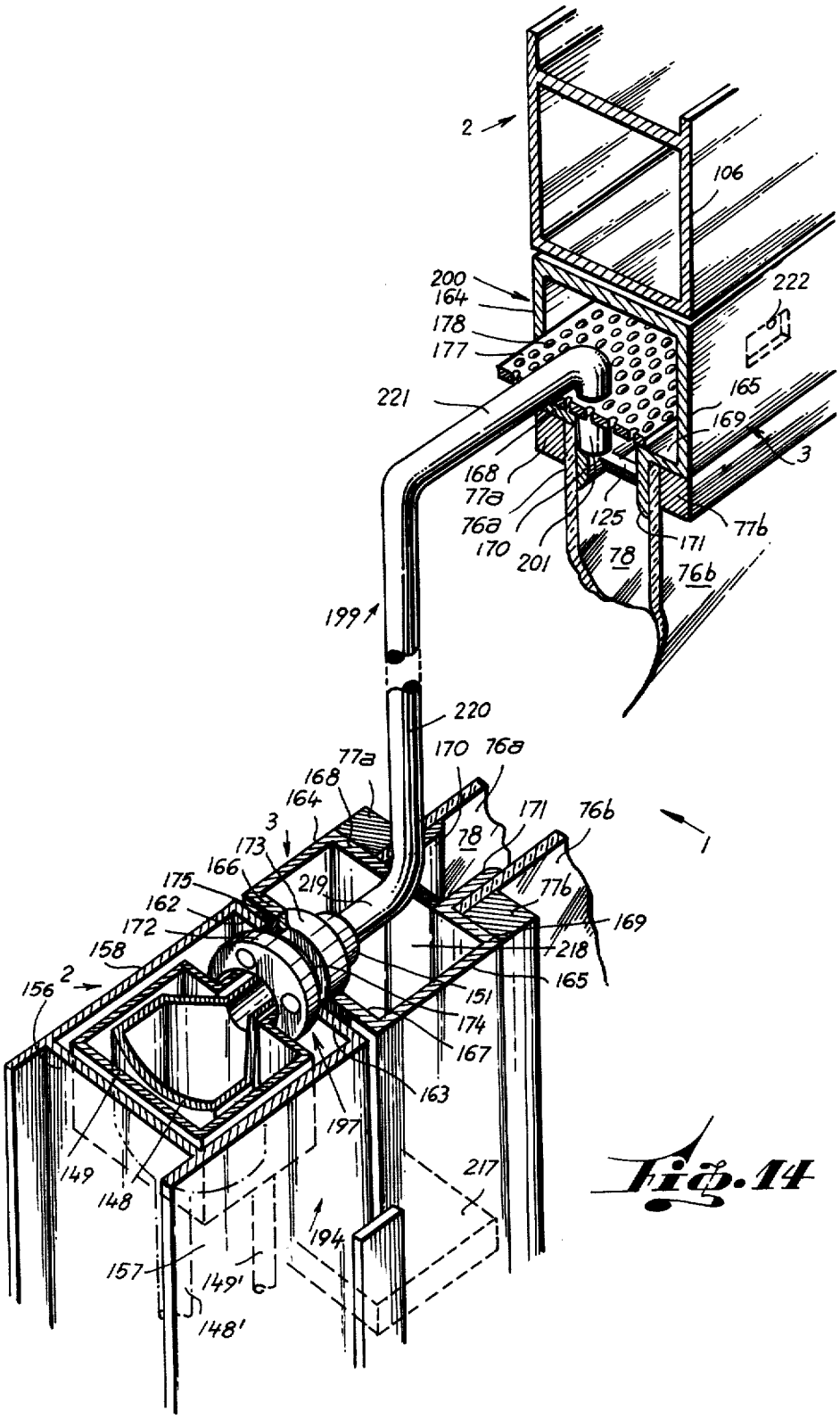
Figure 15:
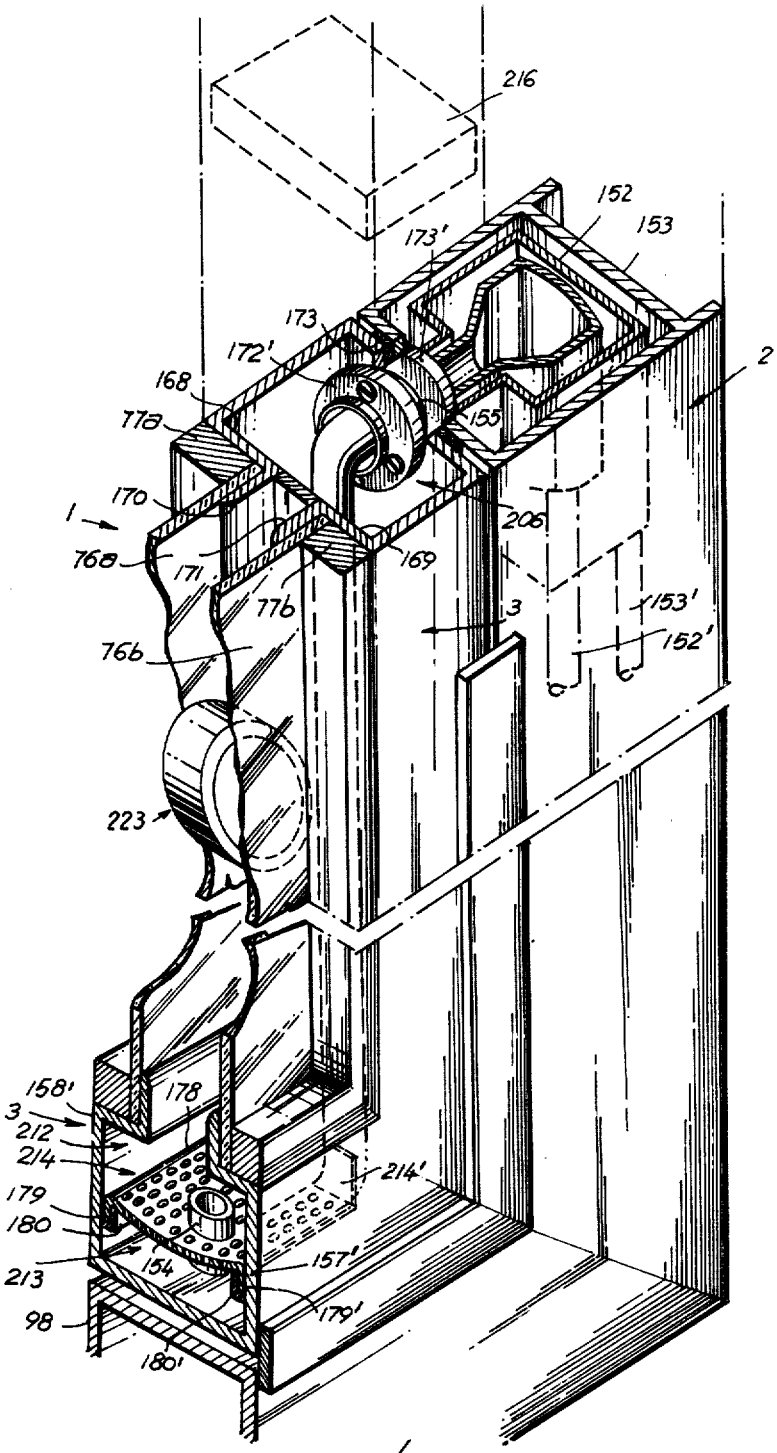

Reference will now be made to FIGS. 14 and 15 which show an actual embodiment of the idea schematically represented in FIG. 11. It will be understood that the embodiments of FIGS. 14 and 15 are easily adapted to the alternative embodiments of 12 and 13 and therefore no additional explanation will be given with regard to the actual embodiments of the alternatives shown in these last mentioned figures. FIGS. 14 shows in detail the arrangement of the components forming the left hand portion of FIG. 11, that is to say the conduits extending upwardly towards the top edge portion of the frame while FIG. 15 shows in detail the conduits which extend towards the bottom edge portion of the movable frame, as shown on the right hand of FIG. 11. Rotative couplings 197 and 206 as well as many other details, are the same or similar to those shown in FIG. 9 and therefore to avoid again describing the same features, the same reference numbers have been used in FIGS. 14 and 15 as in FIG. 9 to identify like or similar parts. One of the noticeable differences in the embodiment of FIG. 14, is that the internal portion of movable frame 3, directed towards space 78 defined between glass panes 76a and 76b, is closed from top to bottom by means of a plate 218. Conduit 199 comprises a portion 219 which is coaxial with rotative coupling 197, and thereafter extends at 90° as shown by reference number 220 upwardly through movable frame 3. At the level of top edge portion 200, conduit 199 is again bent 90° so that portion 221 thereof extends within the top edge portion of the frame and finally is bent downwardly to extend through perforated wall 177 and end in a nozzle 201. This embodiment is appropriate for use in the arrangement shown for example in FIG. 1A. In case that it is not desired to suction air from the upper part of movable frame 3, that is to say in the case where the embodiment of FIG. 1 is to be used, conduits 149 and 149' and air discharge mouth 151 can be eliminated, in which case it will be advisable to provide at least one air outlet such as indicated at 222 to permit the egress of air from the space comprised above perforated plate 197. In FIG. 15, in the bottom edge portion of movable frame 3, there are defined respectively an upper space or part 212 and a lower space or part 213 (see also FIG. 11) above and below respectively of partition 214. The right hand end of upper part 212 is closed by an extension 214' of partition 214 while the left hand end is closed by a perforated wall 215 (only shown in FIG. 11), or element porous to air to thereby permit the flow of air therethrough but not the passage of particulate or spherical material. An optional component shown in FIG. 15 is a viewer 223 which enables an observer to see through the frame structure described in spite of the fact that the space 78 between the panes of glass may be totally filled with opaque particulate material.

Figure 16:
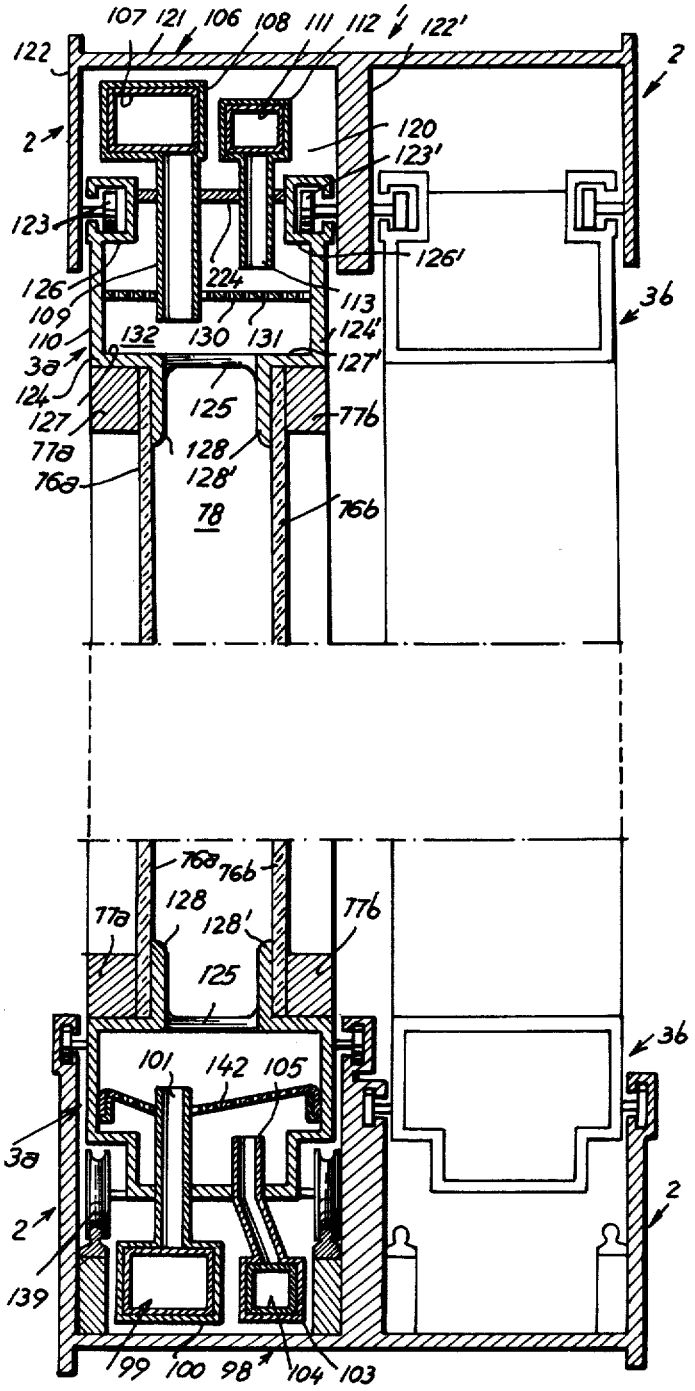
FIG. 16 is a vertical section through an actual embodiment of the panel, similar to that shown in FIGS. 5, 6 and 7, but which permits air to be extracted from the upper portion of the movable frame.

FIG. 16 shows an embodiment which is an alternative of the embodiment shown in FIG. 7. The arrangement shown in FIG. 16 corresponds to a panel comprising two horizontally slidable glass supporting frames mounted within a stationary frame. Only the differences between the embodiments of FIGS. 7 and 16 will be described inasmuch as that the same reference numbers have been used in both figures to identify similar or like parts and therefore such similar or like parts can be understood by referring to the description of FIG. 7. The broad description given with regard to FIG. 5 is also applicable to the embodiment of FIG. 16.

The upper part of movable frame 3a is closed by a plate 224 extending between guide channels 126, 126'. Plate 224 replaces perforated plate 128 of the embodiment of FIG. 7. Plate 224 has a nozzle 109 extending therethrough but there is no free communication for air between space 132 of movable frame 3 and space 120 defined in stationary frame 2. While in the embodiment of FIG. 7 no means is provided for suctioning air from the upper part of movable frame 3, in the embodiment of FIG. 16 such provision is made by nozzle 113 and telescopic conduits 111 and 112. Operation of the embodiment of FIG. 16 is similar to that of FIG. 7 except that conduit 111 is connectable to conduit 46 of FIG. 1A to permit suctioning of air as described in connection with FIG. 1A.

Figures 17, 21:
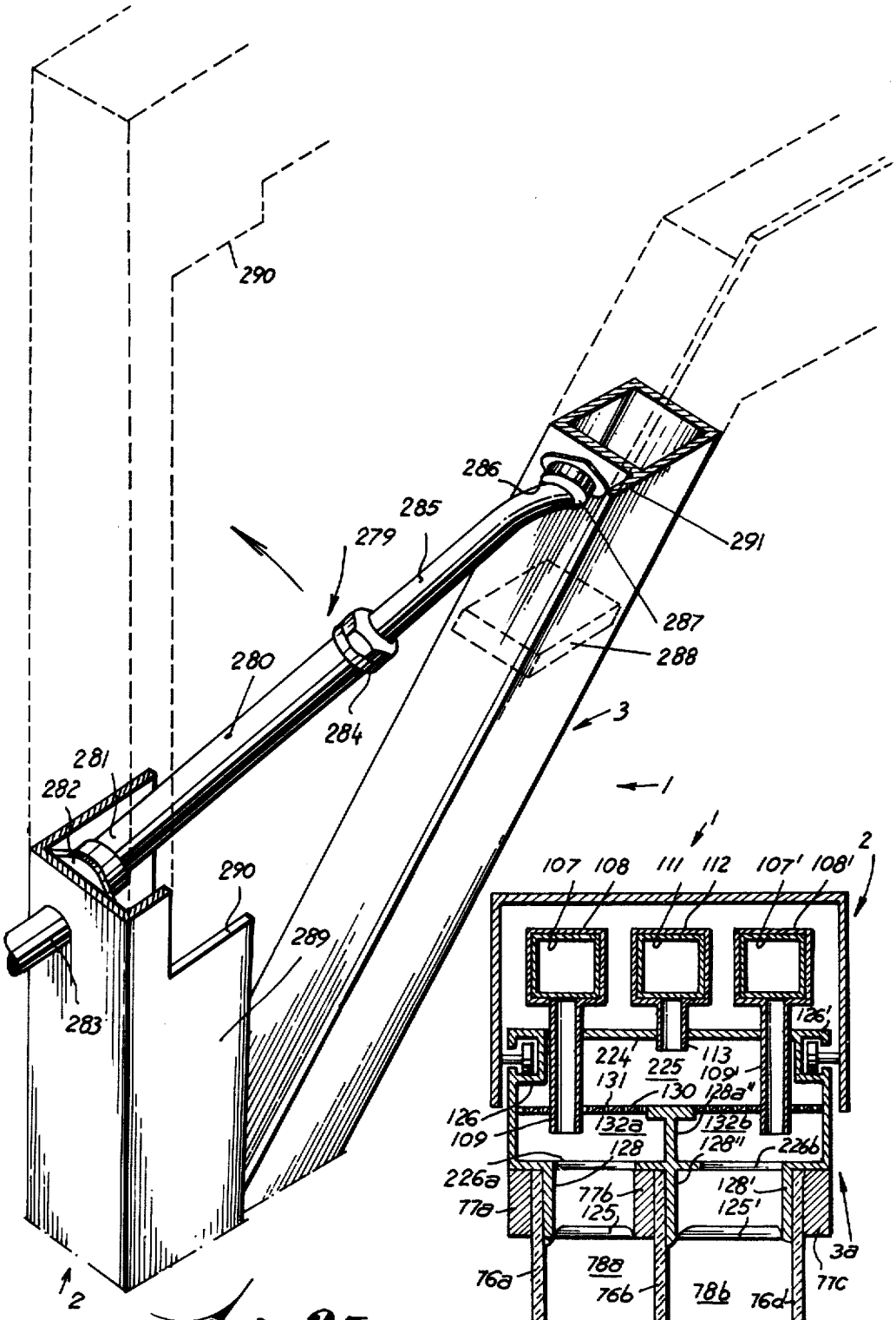
FIG. 17 is a vertical section of the upper portion of a panel which includes a movable frame provided with three sheets of glass defining two laterally positioned spaces therebetween, this embodiment being, in general, somewhat similar to the embodiment shown in FIGS. 5, 6, 7 and 16.
FIG. 21 is a perspective view, partially in section, of a telescopic coupling arrangement which can be used in combination with panels having a movable frame adapted to rotate about a horizontal axis.

FIG. 17 shows an alternative embodiment in which each movable frame 3a (and eventually frame 3b in the case of a panel having two movable frames) has three panes of glass 76a, 76b, 76c whereby each movable frame will include two spaces 78a and 78b capable of being partially or totally filled with the same or different particulate or spherical material so as to thereby vary selectively the radiation transmission properties of the panel. This embodiment is very similar to that of FIG. 16 and the same reference numbers have also been used to identify the same or functionally equivalent components.

Movable frame 3a has three downwardly directed flanges 128, 128' and 128'' spaced apart by bridge portions 125 and 125'. Glass panes 76a, 76b and 76c rest against these flanges and are held in position by auxiliary frames 77a, 77b and 77c thereby defining a space 78a between panes 77a and 77b and a space 78b between panes 77b and 77c. The inside of movable frame 3a is divided into upper spaces 132a and 132b by a perforated plate 130 provided with a multiplicity of perforations 131 which prevent the passage of spherical material therethrough but permit the free flow of air. Lower space 132a is separated from lower space 132b by an extenson 128a'' of flange 128 so as to prevent the spheres discharged into spaces 132a and 78a from becoming mixed with those discharged into spaces 132b and 78b. The arrangement of components 128'' and 128a'' is held in place by reinforcements 226a and 226b spaced apart at regular intervals and which are similar to bridges 125. The upper portion of movable frame 3a, and consequently space 225, is closed by an upper wall 224 extending between guide channels 126 and 126'. Within the upper portion frame 2 three telescopic arrangements are provided; the first of which comprises an inner stationary conduit 107 and an outer sliding conduit 108 having a nozzle 109 for discharging particulate material and air, the second comprises an inner stationary conduit 107' and an outer sliding conduit 108' having a nozzle 109' for discharging particulate material and air, and the third comprises an inner stationary conduit 111 and an outer sliding conduit 112 having a nozzle 113 for suctioning air alone. While nozzles 109 and 109' open out below perforated plate 130 towards spaces 132a and 132b respectively, nozzle 113 opens out above perforated plate 130 towards space 225. As the above mentioned embodiment is appropriate for use in the arrangement shown in FIG. 1A, its connection into such arrangement will depend on the use it is to be given. If spaces 78a and 78b are to be filled with the same type of particulate or spherical material, then conduits 108 and 108' can be connected in parallel. An additional valve or gate, equivalent to gate 8a, can be connected into conduit 108' so as to be able to independently control the ingress of particulate material to spaces 78a and 78b. Conduit 111 will be connected to conduit 46 of FIG. 1A. On the other hand if spaces 78a and 78b are to be filled with different particulate material (for example particulate material having different colours or different transparentness etc.), conduit 111 will be connected to conduit 46, but each conduit 107, 107' will be provided with a complete arrangement comprising its own deposit and its own particulate material conducting conduits with their respective valve or gate.

It will be understood by those skilled in the art that the lower portion of the stationary and movable frames will be identical or very similar to the upper part shown in FIG. 17.

Figure 18:
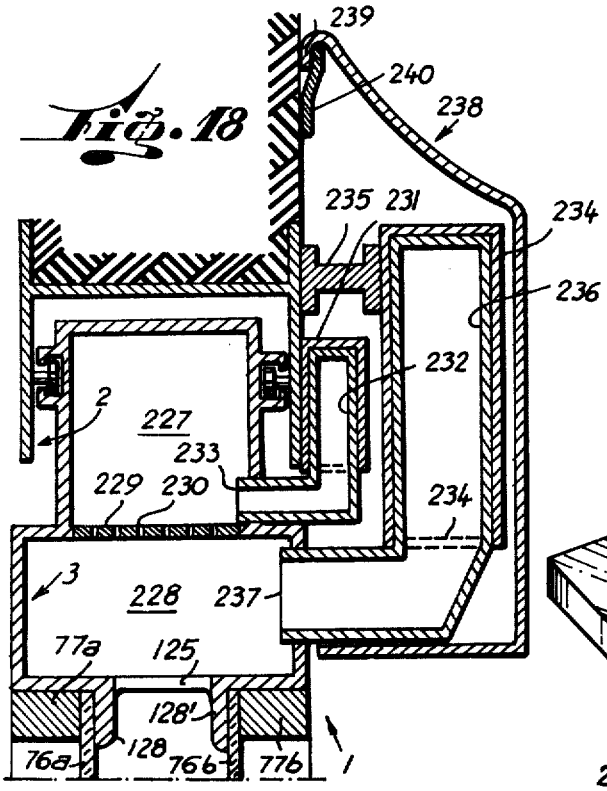
FIG. 18 is a vertical section through the upper portion of a movable frame which is horizontally slidable and in which the telescopic conduits are positioned exteriorly with regard to the panel.
Figure 19:
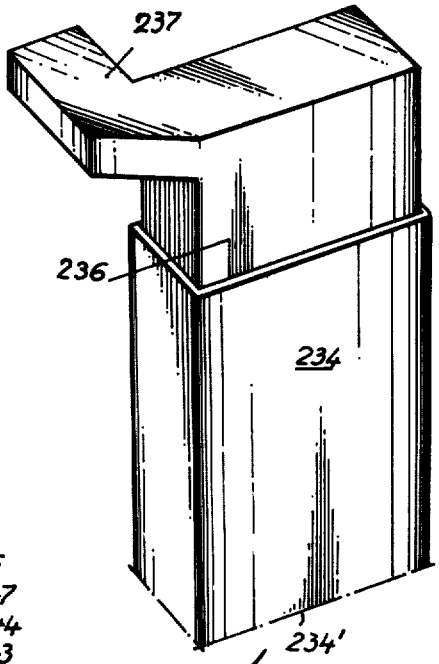
FIG. 19 is a schematic representation of a detail of a panel similar to that of FIG. 18 and which shows one of the arrangements of telescopic conduits.

FIGS. 18 and 19 show an embodiment which is appropriate for use with horizontally slidable panels and particularly to adapt the present invention to existing installations, to which effect it will be sufficient to merely replace the glass supporting frames by new ones similar to those that will be explained. In FIG. 18 it can be seen that within stationary frame 2 there is horizontally slidably mounted a movable frame 3 comprising a hollow upper space 227 and a hollow lower space 228 separated one from the other by a perforated plate 229 having a multiplicity of perforations 230 which are sufficiently small to prevent the passage of particulate or spherical material therethrough but which permit the free flow of air. Similarly to the embodiments above described, flanges 128, 128' are spaced-apart by bridges 125 positioned at appropriate and preferably regular intervals. Glass panes 76a and 76b rest against flanges 128 and 128' and are held in position by means of auxiliary frames 77*a* and 77*b*. It is to be noted that the main difference between this embodiment and the other embodiments described, resides in the fact that the conduits for air and particulate material and for air alone enter the movable frame laterally, instead of doing so from above or from below, and that there are no conduits within the movable and stationary frames. The necessary conduits extend outside such frames. For suctioning air alone there is provided a telescopic arrangement comprising an outer stationary conduit 231 secured to stationary frame 2 (although it can be secured to the structure supporting the frame) and an internal conduit 232 slidably arranged within stationary conduit 231 and which ends in a nozzle 233 directed at 90° and which leads into inner space 227 of movable frame 3. For conducting air and particulate material there is provided a second telescopic arrangement comprising an external stationary conduit 234 secured to stationary frame (or eventually to the structure supporting the frame) by means of an adequate securing arrangement 235, and an internal conduit 236 slidably within external conduit 234 and having at its end a nozzle 237 directed at 90° and leading into an internal space 228 formed in movable frame 3. Inasmuch as that the telescopic arrangements 231, 232 and 234, 236 are visible because they remain outside the frame structure, for appearance reasons a cover of any adequate material, identified in general by reference number 238, can be provided to cover the telescopic arrangements and hide them from sight. Cover arrangement 238 may be removably mounted by means of a flange 239 and support members 240 arranged at appropriate intervals along the structure or wall supporting frame 2. Support members 240 will be adequately designed to receive flanges 239 therein.

FIG. 19 shows a detail of telescopic arrangement 234-236 which is similar to telescopic arrangement 231, 232.

Figure 20:
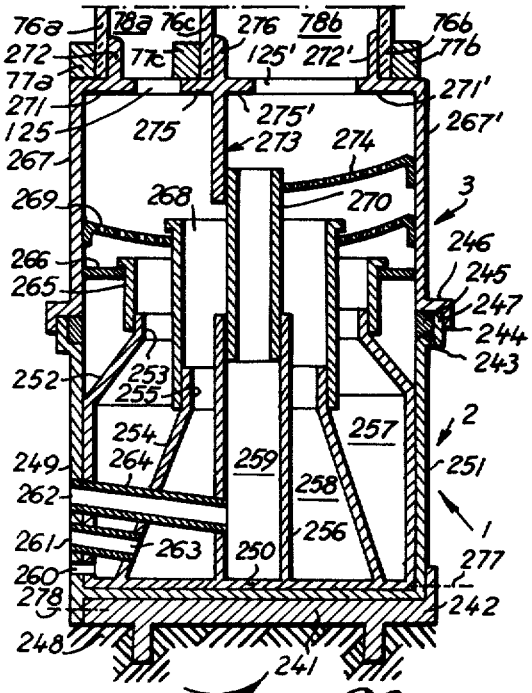
FIG. 20 is a vertical section through the lower portion of a panel built in accordance with the present invention, and showing one form of rotative coupling between the conduits of the stationary frame and the movable frame in association with a panel having three sheets of glass and two spaces therebetween.

FIG. 20 shows a further embodiment in which a double space between glass panes is provided. While the embodiment of FIG. 17 shows a double space in a slidable frame, the embodiment of FIG. 20 shows a double space with a rotatable glass supporting frame. In this embodiment the panel arrangement is mounted within a mounting frame 241 secured to the wall of a building structure and comprising along its outer edge a flange 242, while its inner edge is free from such flange. Stationary frame 2 is of rectangular cross-section, but in the zone of the vertical rotational axis of movable frame 3 it is provided with a circular outwardly directed shoulder 243 and a circular vertical flange 244 directed upwardly. A ring 245 of low friction material is arranged within shoulder 243. Movable frame 3 is of rectangular cross-section, but in the zone of the vertical geometrical axis of movable frame 3 it is provided at its lower edge with a circular shoulder 246 directed outwardly and a downwardly directed circular flange 247. Stationary frame 2 has a flange 248 directed inwardly along the bottom edge. Within stationary frame 2 there is arranged a hollow cylinder 249 having a bottom 250 and a lateral wall 251. The upper edge of lateral wall 251 extends into a hollow cone shaped portion 252 ending in an annular edge 253. A hollow frustrated cone shaped portion 254 extends upwards from bottom 250 and has an upper end defining a vertical flange 255. Finally, from bottom 250 there extends upwardly a further hollow cylinder shaped portion 256. Consequently, three annular chambers 257, 258, 259 are defined within stationary frame 2. Each one of these chambers has a corresponding opening 260, 261, 262 communicating them with atmosphere. Opening 260 is in direct communication with space 257, opening 261 is in direct communication with space 258, through conduit 263 which extends through conical wall 254, and opening 262 is in communication with space 259 by means of a conduit 264 which extends through cylindrical wall 256.

Within movable frame 3 there is positioned a hollow cylindrical member 265 secured at its upper edge to an annular flange 266 extending radially inwardly from the external face of lateral flange 267 of the frame. The lower edge of cylindrical member 265 is in contact with circular edge 253. A second hollow cylindrical member 268 is arranged concentrically within first cylindrical member 265; its upper edge is secured within a circular central opening provided within a perforated plate 269 whose external edge is secured to the internal wall of lateral flange 267. The lower edge of cylinder 268 is in contact with flange 255. Finally, a third hollow cylindrical member 270 is arranged concentrically within hollow cylinder shaped portion 256; the lower end of portion 256 is rotatably and slidably fixed within the upper end of cylinder shaped portion 256. The mounting of the upper end of cylindrical member 270 will be described further on. Lateral flanges 267 and 267' of movable frame 3 end in inwardly directed flanges 271 and 271', from which mounting flanges 272, 272' extend vertically upwardly. Glass panes **76*a*, 76*b* rest against the external faces of flanges 272, 272'** and are held in position by means of auxiliary frames 77*a* and 77*b*. Vertical wall member 273 extends downwardly between flanges 271 and 271'. The lower edge of wall member 273 has a third cylindrical member 270 secured thereto and from wall member 273 up to the internal face of wall 267' of frame 3 there extends a perforated plate 274. Perforated plates 269 and 274 have a multiplicity of small perforations of insufficient diameter to permit the passage therethrough of the particulate or spherical material, but sufficient to permit the free flow of air therethrough. Vertical wall member 273 has two horizontally directed opposing flanges 275 and 275' which at regular intervals are secured to flanges 271 and 271', respectively, by means of bridges 125, 125'. Vertical wall member 273 extends upwardly thereby defining vertical flange 276 against one of whose faces a third pane of glass **76*c*** rests, and which is held in position by an auxiliary frame 77*c*. Both third pane of glass **76*c*** and auxiliary frame 77*c* can be alternatively arranged against the other face of vertical flange 276, thereby increasing the size of space **78*a* and slightly reducing the size of space 78*b***.

Once stationary frame and movable frame 3 are assembled, this assembly is slidably fit into mounting frame 241 until stationary frame 2 abuts against flange 242. In this position it is secured in place by means of screws or any other appropriate means schematically represented by a simple line 277 or movable frame 2 can be secured to mounting frame 241 by means of any appropriate means identified by reference number 278.

If this type of panel structure is used in an arrangement such as that shown in FIG. 1A, opening 260 will be connected to the air only blowing conduit 13, opening 261 will be connected to conduit 12 for discharging particulate material, and opening 262 will be connected to a conduit 12 for discharging particulate material of a second reservoir arrangement 7; reservoir 7 of the first arrangement will contain particulate material of certain properties while the reservoir of the second arrangement will contain particulate material of different properties (for example different colour, opaqueness, etc.). In the event that second space 78 is used simply to increase the opaqueness of the panel, in which case it can be filled with particulate material of the same type, openings 261, 262 can be connected one to the other and to a single reservoir 7, but with the incorporation of a valve 12*a* in each one of the two conduits.

FIG. 21 shows an alternative embodiment which is appropriate for use in tilting windows of the type shown in FIGS. 11 to 15. However, in the present embodiment the conduits, both for air only as well as for air and particulate material, are not connected to the movable frame coaxially with the rotational axis thereof. For each conduit (whether three are used as in the embodiment of FIG. 1, or four as in the embodiment of FIG. 1A) there is provided a telescopic arrangement 279 as shown in FIG. 21. This telescopic arrangement comprises a conduit 280 which at its lower end is bent, outwardly, at 90°, as shown by 281, to thereby be connected to rotatable coupling 282 mounted on stationary frame 2. An external conduit 283 extends outwardly from stationary frame 2 and is in communication with conduit 280. Upper end of conduit 280 is provided with a seal arrangement 284 through which a second conduit 285, of less diameter, telescopically enters conduit 280. The upper end of second conduit 285 is bent inwardly 90° to become connected to a second rotatable coupling 287 mounted on movable frame 3. Second rotatable coupling 287 leads into the inside of movable frame 3 and may continue within the latter up to an appropriate location so as to finally open into the space formed between the two panes of glass (not shown) of the window. If it is desired to conduct air and particulate material to the upper part of the movable frame and prevent them from falling within the frame it is possible to insert a transversal closure member such as shown by dotted lines at 288. Inasmuch as that when movable frame 3 is in its closed position telescopic arrangement 279 must be housed within stationary frame 2, flange 289 thereof must be cut away as shown at 290, in a vertical extent which is equal to the distance between rotatable coupling 282 and second rotatable coupling 287, when movable frame 3 is closed. Although in FIG. 21 a single conduit has been shown, it will be evident to those skilled in the art that at least two conduits will be necessary for injecting and withdrawing particulate material. For withdrawing particulate material a second telescopic arrangement, identical to that shown at 279, will be provided at the lower part of the panel. Additionally, if it is desired to blow air through the lower part of the movable frame, a third telescopic arrangement will be provided at the lower part of the frame but on the opposite side to that at which the second telescopic arrangement is provided. Lastly, if it is desired to withdraw air from the upper part of the frame, a fourth telescopic arrangement will be provided at the upper part of the frame on the side thereof opposite to that at which the first telescopic arrangement is provided. This structure can be completed with other perforated plates, etc. as described when reference is made to other embodiments. It will be noted that flange 291 of movable frame 3, when the latter is closed, will supplement cut out portion 290 of stationary frame 2 so that the telescopic arrangements will be hidden from view.

Figure 22:
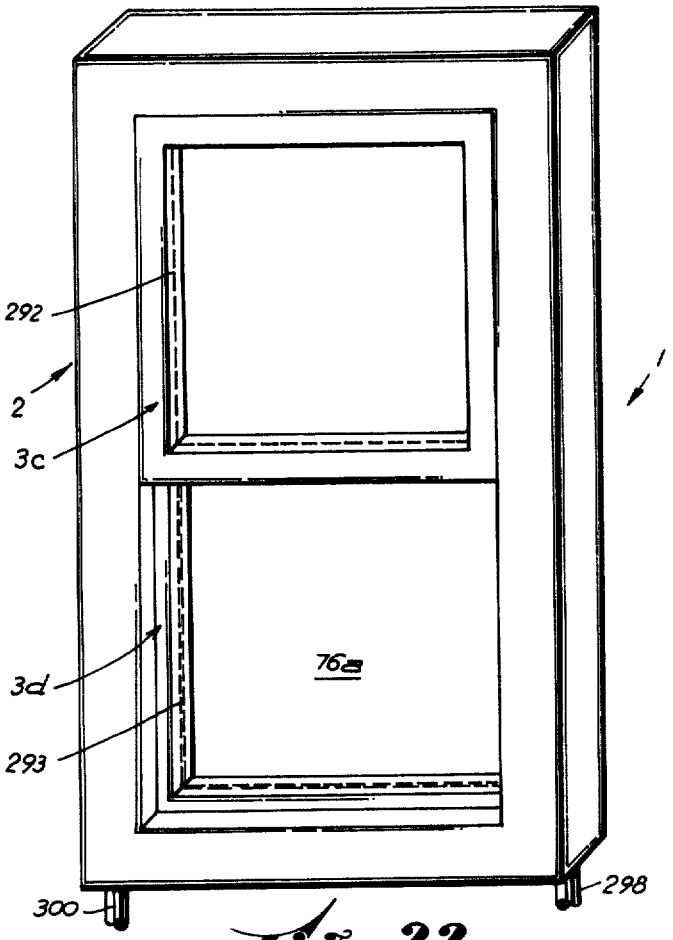
FIG. 22 is a schematic representation of a panel suitable for use in a guillotine type window.
Figure 23:
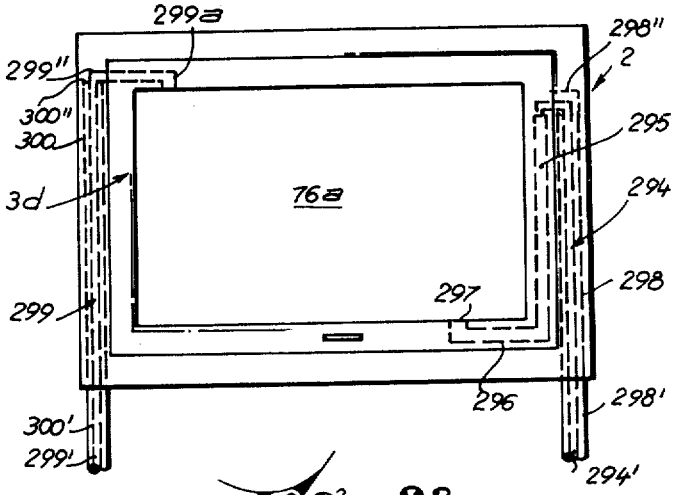
FIG. 23 is a schematic representation of a guillotine type window, showing the telescopic arrangement in the stationary frame and the movable frame.

FIGS. 22 and 23 show a guillotine type window. Basically it is similar to a window having horizontally movable frames but in which both the stationary and movable frames are rotated 90° so as to form the vertically movable arrangement as shown in FIG. 22. Consequently for a clear understanding of this embodiment, reference can also be made to FIG. 5. In the embodiment of FIGS. 22 and 23 only two conduits have been shown (for injecting and withdrawing particulate material; no conduits for blowing air nor for suctioning air have been shown). Obviously, the embodiment shown in FIG. 22 can be easily adapted to the teachings of FIG. 5 by including therein a third and a fourth conduits for blowing air and for suctioning air.

With specific reference to FIG. 22, the window comprises a panel 1 having a stationary frame 2. The upper part of the opening defined by stationary frame 2 has a stationary glass supporting frame 3*c* supporting a single or a double glass. A single glass will be provided when glass supporting frame 3*c* is not to be interconnected into the arrangement of the present invention because modification of the transmission properties of the glass is not desired. However if it is also desired to modify the radiation transmission properties of the upper half of the window then frame 3*c* will support two spaced apart parallel panes defining a space therebetween connectable into the system of the present invention. The position of a single pane of glass has been shown by dotted lines 292. There is also provided a movable frame 3*d* vertically slidable within stationary frame 2. To this effect movable frame 3*c* slides up and down behind stationary frame 3*c*. Interrupted lines 293 show the position of two spaced apart panes of glass only one of which is identified by 76*a*. Consequently, a space is formed between the two panes of glass and it is this space which can be filled totally or partially, with the spherical material for modifying the radiation transmission properties of panel 1.

FIG. 23 only shows the bottom half of the window of FIG. 22. The telescopic conduits (similar to those of FIGS. 5 and 7) are also shown in FIG. 23. However in this embodiment telescopic arrangement 294 is vertically arranged and its outlet extends downwardly at 295 so as to extend into the lower part of movable frame 3*c* to which effect it is provided with a horizontal portion 296 and an injecting nozzle 297. Telescopic arrangement 294 extends outside of stationary frame 2 by means of conduit 298 connectable to conduit 12 of FIGS. 1 and 1A. On the opposite side of movable frame 3*d* there is provided a second telescopic arrangement 299 similar to telescopic arrangement 294 but which has an upper end forming a horizontal conduit 299' which extends into the space formed between the two panes of glass (one of which has been identified by reference 76*a*) through nozzle 299''. Telescopic arrangement 299 is connected to conduit 8 of the embodiment shown in FIGS. 1 and 1A by means of conduit 300.

If it is desired to inject air into the lower part of movable frame 3*d* then an additional telescopic arrangement can be provided (similar to that shown in FIG. 5). Such additional telescopic arrangement will be connected to conduit 13 of the embodiment of FIGS. 1 or 1A. If it is desired to suction air from the upper part of movable frame 3*d* then a fourth telescopic arrangement will be provided parallel to arrangement 299 and it will be connected to conduit 46 of FIG. 1A. The frames of the arrangement of FIGS. 22 and 23 can also include the various auxiliary components such as perforated plates, described in detail with regard to the other embodiments.

It has been said that it may be desirable to provide an arrangement in which the inner faces of panes 76a and 76b can be cleaned. To this effect the embodiment of FIG. 24 is provided and in which pane 4a is mounted in a frame 301 pivoted at 302, 302' to movable frame 3. Likewise, frame 4b can be integral with movable frame 3 or also pivoted thereto, if desired.

FIGS. 25A to 25D show various optional alternative embodiments of certain details of the electric control circuit shown in FIG. 2.

FIG. 25A shows an embodiment whereby it is possible to avoid the necessity for the user to keep pressing push-button switch 48 while the panel is being filled with particulate material. To the above effect, a timer is provided which in response to an energization pulse, will keep the circuit connected during a predetermined interval after which the circuit will be interrupted until a new energization pulse is received. Timer 303 is fed through energization inputs 304, 304' from terminals 47a, 47b of an electric power source. Furthermore, timer 303 includes a firing input 305 connected to one of the terminals of normally open push-button 48a. Dotted lines 48', 48" indicate that there is at least another push-button connected in parallel with push-button 48a when the arrangement is used in combination with more than one panel. Timer 303 has an output 306 connected (as shown by reference number 307) to winding 51 of relay 52 (FIG. 2). When push-button 48a is momentarily closed an energization pulse will be applied to the input 305 of timer 303 which will thereby become energized thus als energizing relay 52 through output 306. The duration of the energization of relay 52 will depend on the setting of timer 303 and in general will be sufficient to substantially permit the panel to be filled with the spherical or particulate material. Once the said period of energization of timer 303 has lapsed, it will automatically de-energize relay 52 and it will not again energize this relay until a new energizing pulse is received at input 305.

FIG. 25B shows an arrangement aimed at providing a similar result to that provided with the arrangement of FIG. 25A. In this case relay 52 includes an additional set of normally open self-retaining contacts 308a, 308b. Winding 51, when push-button 48a is actuated, will receive electrical current from terminals 47a and 47b thereby closing contacts 308a, 308b and 53a–53b by means of movable contacts 309 and 54. Consequently, energization of winding 51 will be established because a closed circuit is formed from terminal 47b, second push-button 310a (normally closed), contacts 308a and 308b, winding 51 back to terminal 47a. Relay 52 will remain energized as long as second push-button 310a is not actuated. After having actuated push-button 48a and then released it, the panel will begin to be filled with the particulate or spherical material; when the user notices that the level of particles in the panel has reached the level he desires, he actuates push-button 310a whereby the circuit will become momentarily de-energized thus de-energizing relay 52. Consequently movable contact 309 will open connection between stationary contacts 308a and 308b. Obviously, in those cases where the panels are individually controlled, contacts 53a and 53b will control the air and air and particle flow control valves instead of controlling motor 17. To this effect, such valves will comprise a relay energizable through contacts 53a, 53b.

FIG. 25C shows the use of a timer 311 to control dehumidifier 60 independently of humidistat 58. Timer 311 is electrically fed from terminals 312, 313 connectable to an electric power source. Timer 311 also has a firing input 314 which is connectable to terminal 312 when normally open push-button 66 is actuated. Finally, timer 311 has an output 315. A conventional switch 316 is connected in parallel with timer 311 and push-button 66. The contacts of switch 59 of humidistat 58 are connected in parallel with all the arrangement formed by push-button 66, timer 311 and switch 316. A push-button 66 can be positioned adjacent each panel or group of panels, in which case all the push-buttons 66 will be connected in parallel.

If the user of any panel notices the presence of moisture therein all he has to do is briefly press push-button 66 thereby firing timer 311 which will close its output contacts thereby energizing electric motor 61 of dehumidifier 60 through electrical connection 317. After a short interval of time, preestablished by timer 311, the latter will automatically open its output contacts thus de-energizing electric motor-compressor 61. In case of necessity push-button 66 can be again briefly actuated to establish a new dehumidification cycle. Under normal operating conditions humidistat 58 will normally close switch 59 in response to moisture or dampness values above a predetermined minimum so as to energize motor-compressor 61 independently of the manual actuation of push-button 66 and independently of switch 316. Switch 316 is preferably positioned close to a central control station whereby the dehumidifier can be permanently energized independently of the humidistat and the manual energization push-button 66. Obviously, according to circumstances either one or the other or all of the foregoing (timer 311, push-button 66 and switch 316) can be provided in an actual embodiment.

FIG. 25D shows the use of a timer for controlling a heater 67 independently of thermostat 68. Timer 318 will be electrically fed from a power source through conductors 319, 320. Additionally timer 318 has a firing input 312 which, through a normally open push-button 72, is connectable to the power source through conductor 319. Finally, timer 318 has an output 322. A conventional switch 323 is connected in parallel with the series arrangement of timer 318 and push-button 72. Also in parallel with the arrangement comprising push-button 72, timer 318 and switch 323 there are connected the contacts of a selector switch 70 of the heater capable of selecting, due to the effect of thermostat 78, (FIG. 2) one of three possible modes: (a) heater de-energized (contact 70c); (b) medium heating (contact 70b and resistor 71b); and (c) maximum heating (contact 70a and resistor 71a). Push-button switch 72, timer 318 and switch 323 only act on resistor 71b corresponding to medium heating. However, it will be seen that selector switch 70 is connected in tandem (as shown by interrupted line 324) with a second selector switch 70' through which push-button 72, switch 323 and timer 318 are connectable to conductor 319. This has the aim of avoiding that resistor 71b can be connected into the circuit by the optional control arrangement when the thermostat has previously driven selector switch 70 into contact with stationary contact 70a inasmuch as this would cause over-heating. Other push-buttons 72 can be connected in parallel with the one shown in which case each one will be positioned close to the reach of the user of each panel. Switch 323 will be preferably positioned at the central control station. Although the thermostat may retain selector switch 70 in contact with stationary contact 70c, that is to say with the heater disconnected, the optional control arrangements can be used for feeding heat into the panel. The same can occur when switch 70 is in position 70b but not when switch 70 is in position 70a. Consequently in case of failure of the thermostat, and if switch 70 is in position 70c temporary heating can be provided by actuation of push-button 72 and energization of timer 318, or permanently by means of switch 323 although in both cases only medium heating will be provided.

Although the particulate or spherical material used for carrying out the present invention is preferably expanded polyurethane, either coloured or white, or beads of fire retardant polystyrene or particles of rigid urethane, it will be obvious to those skilled in the art that many other low density, heat insulating and/or sound insulating and/or light blocking material having good wear resistant properties can be used.

It will be understood that improvements and modifications may be introduced into the invention described by way of example without departing from the scope of the invention specifically defined in the following claims.

I claim:

1. In an arrangement for selectively varying the radiation and vibration transmitting properties of panels usable in buildings and other structures, comprising a panel having two substantially parallel sheets of transparent or translucid material mounted in a supporting frame, said two sheets being spaced apart and defining therebetween an intermediate space for receiving, from a reservoir, low density solid particulate material having predetermined thermal and/or optical characteristics; the improvement comprising:

first inlet means disposed in the upper part of said intermediate space for introducing fluidized particulate material into said intermediate space to fill at least a portion of said intermediate space so as to render said portion of said intermediate space less radiation transmissive, outlet means vertically spaced below said first inlet means for removing said particulate material filling said portion of said intermediate space and returning same to the reservoir, and second inlet means disposed at substantially the same level as said outlet means and horizontally spaced from said outlet means for introducing air only into said intermediate space and for urging said particulate material toward said outlet means;

whereby, during and after filling of said intermediate space, said air introduced by said second inlet means levels the particulate material introduced by said first inlet means, and, during removal of said particulate material, said air introduced by said second inlet means urges said particulate material toward said outlet means.

2. In the arrangement of claim 1, further comprising additional outlet means in the upper part of said intermediate space for removing said air only from said intermediate space.

3. In the arrangement of claim 2, further comprising air blower means connected to said second inlet means for blowing air only into said intermediate space.

4. In the arrangement of claim 3, further comprising dust filter means connecting said additional outlet means to said air blower means for recirculating and filtering said air only removed from said intermediate space.

5. In the arrangement of claim 3, wherein said air blower means includes an air blower and an electric two-speed motor for driving said air blower.

6. In the arrangement of claim 5, further comprising a two-position selector switch having two stationary contacts, and a pressurestat including a pressure sensitive control element mechanically coupled to said two-position selector switch, said electric, two-speed motor having a set of terminals, each one of said two stationary contacts being connected to said set of terminals of said electric, two-speed motor, said set of terminals corresponding to one of the speeds of said electric, two-speed motor, said pressurestat being connected to said second inlet means downstream of said air blower.

7. In the arrangement of claim 4, wherein said dust filter means includes an air inlet communicating with the atmosphere.

8. In the arrangement of claim 3, wherein said air blower means includes an outlet, said arrangement further comprising a by-pass conduit bypassing said air blower means, and a pressure-sensitive valve arranged in said by-pass conduit and adapted to be opened in response to a pressure at the outlet of said air blower means above a predetermined value of pressure.

9. In the arrangement of claim 1, further comprising an electric motor-driven dehumidifying device comprising an air input and an air output both connected to said second inlet means, said air input of said dehumidifying device being upstream of said air output of said dehumidifying device, and further comprising an air gate adapted to be selectively set to a first position closing said air input of said dehumidifying device, and a second position closing said second inlet means downstream of said air input of said dehumidifying device.

10. In the arrangement of claim 9, further comprising air blower means connected to said second inlet means for blowing air only into said intermediate space, said air blower means having an outlet, and further comprising a humidistat arranged between the output of said air blower means and said input of said dehumidifying device, said electric motor driving said dehumidifying device having a power input, said arrangement further comprising an electric switch connected in series with said power input of said electric motor driving said dehumidifier, said humidistat comprising a moisture-sensitive member coupled to said electric switch and being adapted to close said electric switch in response to a moisture content above a predetermined value.

11. In the arrangement of claim 10, further comprising a normally open auxiliary switch connected in parallel with said electric switch.

12. In the arrangement of claim 11, further comprising an adjustable timer connected in series with said auxiliary switch.

13. In the arrangement of claim 1, further comprising a heater for heating the air flowing in said arrangement, and comprising an air inlet and an air outlet both connected to said second inlet means, said air inlet of said heater being upstream of said air outlet of said heater, said arrangement further comprising an air gate adapted to be selectively set to a first position for closing said air inlet of said heater and to a second position closing said air inlet means upstream of said air outlet of said heater.

14. In the arrangement of claim 13, further comprising air blower means connected to said second inlet means for blowing air only into said intermediate space, said air blower means having an outlet, said arrangement further comprising a thermostat arranged to sense the temperature of the air in said air inlet means between the output of said air blower means and the air inlet of said heater means, a selector switch associated with said thermostat, a plurality of resistors, and an electric power source, said selective switch connecting said plurality of resistors selectively to said electric power source in response to the temperature of the air in said second inlet means, said selector switch being provided with a first section comprising a movable contact and three stationary contacts, a first one of said three stationary contacts being open, a second one of said three stationary contacts being connected to a first one of said plurality of resistors, and a third one of said stationary contacts being connected to a second one of said plurality of resistors.

15. In the arrangement of claim 14, further comprising a normally open auxiliary switch connected between the movable contact of said selector switch and the second one of said three stationary contacts.

16. In the arrangement of claim 15, wherein said selector switch comprises a second section mechanically connected in tandem to said first section, said second section comprising a movable contact and three stationary contacts, a second one and a third one of said three stationary contacts of said second section being connected one to the other and to the movable contact of said first section, said arrangement further comprising an adjustable timer having a firing input and an output, said auxiliary switch being electrically connected between a movable contact of said second section and said firing input of said adjustable timer, said output of said adjustable timer being connected to said second one of said three stationary contacts of said first section.

17. In the arrangement of claim 16, wherein said adjustable timer and said auxiliary switch are connected in parallel with an additional switch.

18. In the arrangement of claim 1, further comprising air blower means connected to said second inlet means for blowing air only into said intermediate space, said air blower means having an outlet, said arrangement further comprising at least one normally open electric switch, each said at least one normally open electric switch being positioned closely adjacent to said panel, said arrangement further comprising a relay having a winding and control contacts, said air blower means further comprising an air blower and an electric, two-speed motor for driving said air blower, said normally open electric switch being connected in series with the winding of said relay, said relay having said control contacts connected in series with said electric motor of said air blower.

19. In the arrangement of claim 18, comprising at least one additional panel, said panel and said at least one additional panel forming a plurality of panels, said arrangement further comprising a plurality of normally open electric switches, one for each said panel, said plurality of switches being connected in parallel.

20. In the arrangement of any one of claims 18 or 19, further comprising an adjustable timer connected in series with each one of said normally open electric switches.

21. In the arrangement of claim 18, further comprising an additional switch, and wherein said relay comprises a set of self-retaining contacts connected in series with said additional switch, the combination of said self-retaining contacts and the additional switch being connected in parallel with said electric switch.

22. In the arrangement of claim 1, wherein said panel has a substantially hollow stationary frame, said first inlet means comprising a first conduit positioned in said hollow stationary frame and having one end extending outside said hollow stationary frame, said first conduit having another end leading into said intermediate space, said outlet means comprising a second conduit having one end extending outside said stationary frame and another end leading into the lower part of said intermediate space, said second inlet means comprising a third conduit positioned within said hollow stationary frame and having one end extending outside said hollow stationary frame and another end extending into said intermediate space at a position spaced apart from said other end of said second conduit.

23. In the arrangement of claim 22, further comprising additional outlet means in the upper part of said intermediate space for removing said air only from said intermediate space, said additional outlet means comprising a fourth conduit arranged within said hollow stationary frame, and having one end extending outside said hollow stationary frame and another end extending into said intermediate space at the upper part thereof.

24. In the arrangement of claim 22, further comprising filter means positioned at said other end of said fourth conduit for permitting the flow of air and inhibiting the flow of particulate material therethrough.

25. In the arrangement of claim 1, wherein said panel has a substantially hollow stationary frame in which at least one, substantially hollow, movable frame is slidably mounted for horizontal movement, said movable frame supporting said two substantially parallel sheets of transparent or translucid material defining said intermediate space therebetween, said first inlet means comprising a first conduit arrangement mounted within said substantially hollow stationary frame and having one end extending outside said substantially hollow stationary frame and another end opening into said intermediate space at the upper part thereof, said outlet means comprising a second conduit arrangement mounted within said substantially hollow stationary frame and having one end extending outside said substantially hollow stationary frame and another end opening into said intermediate space at the lower part thereof, said second inlet means comprising a third conduit arrangement mounted within said substantially hollow stationary frame and having one end extending outside said substantially hollow stationary frame and another end opening into said intermediate space at the lower part thereof, said first, second and third conduit arrangements each comprising two telescopic conduits, one of said two telescopic conduits being secured to said substantially hollow stationary frame, the other of said two telescopic conduits being secured to the movable frame and being movable therewith.

26. In the arrangement of claim 25, further comprising additional outlet means in the upper part of said intermediate space for removing said air only from said intermediate space, said additional outlet means comprising a fourth conduit arrangement housed within said substantially hollow stationary frame and having one end extending outside said substantially hollow stationary frame and another end extending into said intermediate space at the upper part thereof, said fourth conduit arrangement comprising two telescopic conduits, one of said two telescopic conduits being secured to said substantially hollow stationary frame and defining said one end, the other of said two telescopic conduits being secured to said movable frame and defining said other end extending into said intermediate space.

27. In the arrangement of claim 1, wherein said panel has a substantially hollow stationary frame wherein at least one substantially hollow movable frame is rotatably mounted about a vertical axis of rotation, each one of said movable frames supporting said two substantially parallel sheets of transparent or translucid material defining an intermediate space therebetween, said first inlet means comprising a first conduit arrangement mounted within said substantially hollow stationary frame and having one end extending outside said substantially hollow stationary frame and another end directed through the upper part of said movable frame into the upper part of said intermediate space, said first conduit arrangement being coaxially aligned with said vertical axis of rotation, said outlet means comprising a second conduit arrangement mounted within said substantially hollow stationary frame and having one end extending outside said substantially hollow stationary frame and another end directed through the lower part of said movable frame into the lower part of said intermediate space, said second conduit arrangement being coaxially aligned with said vertical axis of rotation, said second inlet means comprising a third conduit arrangement mounted within said substantially hollow stationary frame and coaxial with said second conduit arrangement, said third conduit arrangement having one end extending outside said substantially hollow stationary frame and another end directed through the lower part of said movable frame coaxially with said second conduit arrangement and with said vertical axis of rotation, said other end of said third conduit arrangement being directed into the lower part of said intermediate space.

28. In the arrangement of claim 27, further comprising additional outlet means in the upper part of said intermediate space for removing said air only from said intermediate space, said additional outlet means comprising a fourth conduit arrangement positioned within said substantially hollow stationary frame coaxially with said second conduit arrangement, said fourth conduit arrangement being mounted within said stationary frame and having one end extending outside said substantially hollow stationary frame and another end directed through the upper part of said movable frame, coaxially with said first conduit arrangement and with said vertical axis of rotation, into the upper part of said intermediate space.

29. In the arrangement of claim 1, wherein said panel has a substantially hollow stationary frame in which one substantially hollow movable frame is rotatably mounted about a horizontal axis of rotation, said movable frame supporting said two substantially parallel sheets of transparent or translucid material defining said intermediate space therebetween, said first inlet means comprising a first conduit arrangement mounted within said substantially hollow stationary frame and having one end extending outside said substantially hollow stationary frame and another end extending from said substantially hollow stationary frame to said movable frame coaxially with said horizontal axis of rotation, and extending within said movable frame into said intermediate space at the upper part thereof, said outlet means comprising a second conduit arrangement mounted within said substantially hollow stationary frame and having one end extending outside said substantially hollow stationary frame and another end extending from said substantially hollow stationary frame to said movable frame coaxially with said horizontal axis of rotation, and extending within said movable frame and opening into said intermediate space at the lower part thereof, said second inlet means comprising a third conduit arrangement mounted within said substantially hollow stationary frame and having one end extending outside said substantially hollow stationary frame and another end extending from said substantially hollow stationary frame to said movable frame coaxially aligned with said horizontal axis of rotation, and extending within said movable frame into said intermediate space at the lower part thereof.

* * * * *